US009504336B2

(12) United States Patent
Dodd

(10) Patent No.: US 9,504,336 B2
(45) Date of Patent: Nov. 29, 2016

(54) CONFIGURABLE BED

(71) Applicant: Jon Dodd, Littleton, CO (US)

(72) Inventor: Jon Dodd, Littleton, CO (US)

( * ) Notice: Subject to any disclaimer, the term of this patent is extended or adjusted under 35 U.S.C. 154(b) by 0 days.

(21) Appl. No.: 14/180,077

(22) Filed: Feb. 13, 2014

(65) Prior Publication Data

US 2014/0289964 A1 Oct. 2, 2014

Related U.S. Application Data

(60) Provisional application No. 61/764,419, filed on Feb. 13, 2013.

(51) Int. Cl.
*A47C 31/12* (2006.01)

(52) U.S. Cl.
CPC ..... *A47C 31/123* (2013.01)

(58) Field of Classification Search
CPC ... A47C 31/123; A47C 23/061; A47C 27/18
USPC ..... 5/236.1, 239, 241, 613, 659, 731, 733, 5/933, 934, 944
See application file for complete search history.

(56) References Cited

U.S. PATENT DOCUMENTS

| | | | | | |
|---|---|---|---|---|---|
| 42,368 | A | * | 4/1864 | Grote | 5/716 |
| 1,045,228 | A | | 11/1912 | Weltmer | |
| 2,373,421 | A | * | 4/1945 | Schenker | 5/244 |
| 2,469,084 | A | | 5/1949 | Schenker | |
| 2,836,836 | A | | 6/1958 | Cohen | |
| 3,298,363 | A | | 1/1967 | Parkin | |
| 3,340,548 | A | | 9/1967 | Janapol | |
| 3,378,861 | A | | 4/1968 | Lousberg | |
| 3,656,190 | A | | 4/1972 | Regan et al. | |
| 3,885,258 | A | * | 5/1975 | Regan | 5/727 |
| 4,665,573 | A | * | 5/1987 | Fiore | 5/731 |
| 4,688,283 | A | | 8/1987 | Jacobson et al. | |
| 4,692,952 | A | * | 9/1987 | Dougher et al. | 5/37.1 |
| 4,827,544 | A | * | 5/1989 | Husler | 5/236.1 |
| 4,972,535 | A | | 11/1990 | Goldman | |
| 5,075,912 | A | * | 12/1991 | Elmalek et al. | 5/236.1 |
| 5,109,558 | A | | 5/1992 | Di Blasi | |
| 5,127,114 | A | * | 7/1992 | Horburger | 5/239 |
| 5,210,889 | A | * | 5/1993 | Wesemann et al. | 5/236.1 |
| 5,224,226 | A | | 7/1993 | Groenewald | |
| 5,231,717 | A | | 8/1993 | Scott et al. | |
| 5,265,290 | A | * | 11/1993 | Van Raemdonck | 5/236.1 |
| 6,003,178 | A | * | 12/1999 | Montoni | 5/690 |
| 6,298,505 | B1 | * | 10/2001 | Brivio | 5/236.1 |
| 6,487,738 | B1 | * | 12/2002 | Graebe | 5/719 |
| 6,807,698 | B2 | | 10/2004 | Torbet et al. | |

(Continued)

FOREIGN PATENT DOCUMENTS

| | | | |
|---|---|---|---|
| EP | 0870449 | A2 | 3/1998 |
| EP | 1776902 | A1 | 10/2006 |

*Primary Examiner* — David E Sosnowski
*Assistant Examiner* — Myles Throop
(74) *Attorney, Agent, or Firm* — Sheridan Ross P.C.

(57) ABSTRACT

A sleep system includes a sleep surface with a customized profile. The profile of the sleep surface is particularly and specifically designed to maintain a proper sleeping position for an individual. The sleeping surface can include two or more portions that have configurations that ensure the straight alignment of the spine for a person sleeping on the sleep surface. This type of sleep system is customized to each person and, thus, provides a beneficial sleeping position that is individualized and provides the best support for the particular sleeper.

21 Claims, 27 Drawing Sheets

(56) References Cited

U.S. PATENT DOCUMENTS

| | | | | |
|---|---|---|---|---|
| 6,857,148 | B2 * | 2/2005 | Van Raemdonck | 5/617 |
| 6,957,465 | B1 | 10/2005 | Oprandi | |
| 7,065,816 | B2 | 6/2006 | McGettigan | |
| 7,536,740 | B1 | 5/2009 | Swartz | |
| 7,540,048 | B2 | 6/2009 | Piraino | |
| 7,921,491 | B2 * | 4/2011 | Hsu | 5/710 |
| 8,117,700 | B2 | 2/2012 | Howard | |
| 8,341,786 | B2 | 1/2013 | Oexman et al. | |
| 9,033,901 | B2 * | 5/2015 | Woolfson | A61B 5/1077 382/100 |
| 9,179,781 | B2 * | 11/2015 | Melsen | A47C 27/148 |
| 2005/0209049 | A1 * | 9/2005 | Shields | 482/8 |
| 2008/0221487 | A1 * | 9/2008 | Zohar et al. | 600/595 |
| 2012/0137444 | A1 | 6/2012 | Wong | |
| 2012/0167300 | A1 * | 7/2012 | Bonac | 5/236.1 |
| 2012/0192357 | A1 | 8/2012 | Melsen | |

* cited by examiner

CONFIGURABLE BED

CROSS REFERENCE TO RELATED APPLICATION

The present application claims the benefits of and priority, under 35 U.S.C. §119(e), to U.S. Provisional Application Ser. No. 61/764,419, filed Feb. 13, 2013, entitled "CONFIGURABLE BED," which is incorporated herein by reference in its entirety for all that it teaches and for all purposes.

BACKGROUND

The benefits of a healthy and long night's sleep are becoming more apparent, both in the medical industry and in society in general. To obtain a better night's sleep, consumers have been spending millions of dollars on new bedding or sleep systems that provide a more comfortable sleeping surface. Generally, these sleep systems provide some type of adjustment in the mattress or padding of the sleep system that allows a more comfortable sleeping position or environment. Some of these sleep systems provide some individualization in that a sleeper may select a comfort level or softness level of the mattress. However, the existing sleep systems do not tend to provide an individualized sleeping platform that is customized to each individual. Existing sleep systems allow for general modifications that are not particularly geared to each sleeper.

SUMMARY

Embodiments presented herein provide several examples of a sleep system that includes a sleep surface with a customized profile. The profile of the sleep surface that is particularly and specifically designed to maintain a proper sleeping position for an individual. The sleeping surface can include two or more portions that have configurations that ensure a low-stress alignment of the spine for a person sleeping on the sleep surface. This type of sleep system is customized to each person and, thus, provides a beneficial sleeping position that is individualized and provides the best support for the sleeper.

Embodiments include a sleep system comprising: one or more members, each member comprising: a second side resting on a bearing surface; a first side, wherein a profile is formed in the first side, the profile forming a support surface for the sleep system; a first end; a second end; wherein the user sleeps on the support surface with a head of the user at the second end and a foot of the user at the second end; wherein the profile of the first side maintains a spine of the user in a substantially low-stress neutral spinal shape position; wherein the profile is specific to the user; wherein the profile is based on measurements made of the user while the user was standing in a relaxed position; wherein the measurements are based on an interaction of a body of the user and a mattress; and wherein the measurements are made by applying a force to a user, wherein the force is based on a body mass distribution of the user.

An aspect of the above sleep system includes wherein the one or more members are made from a rigid material.

An aspect of the above sleep system includes wherein the rigid material is a plastic, a metal, or a wood.

An aspect of the above sleep system includes wherein the first profile is one of formed or carved into the first side.

An aspect of the above sleep system includes wherein the one or more members include two or more portions, wherein each portion has a width that is less than a length of the member, and wherein the two or more portions form the profile.

An aspect of the above sleep system includes wherein each portion includes an angle of the profile.

An aspect of the above sleep system includes wherein each portion includes a height from the bearing surface to the first side.

An aspect of the above sleep system includes wherein the force is based on a required support for a body segment of the user that is positioned over the portion.

An aspect of the above sleep system includes further comprising two or more slats, each slat affixed to the first side of two or more members, wherein the slat spans between two or more members, wherein a top of the slat forms a first sleep surface.

An aspect of the above sleep system includes wherein each slat is formed from a second rigid material.

An aspect of the above sleep system includes wherein the second rigid material is one of a plastic, a wood, or a metal.

An aspect of the above sleep system includes wherein each slat has a width substantially similar to the width of the portion.

An aspect of the above sleep system further comprises a mattress placed upon the two or more slats.

An aspect of the above sleep system includes wherein a top of the mattress forms a second sleep surface.

An aspect of the above sleep system includes wherein the mattress is formed from a compliant material.

An aspect of the above sleep system includes wherein the compliant material is a foam.

An aspect of the above sleep system includes wherein the two or more members include a raised section formed to support the head of the user.

An aspect of the above sleep system includes wherein the two or more members are configured as a box spring.

Embodiments include a sleep system, comprising: two or more members separated by a distance, each member comprising: a second side resting on a bearing surface; a first side, wherein a profile is formed in the first side, wherein the profile of the first side maintains a spine of the user in a substantially low-stress neutral spinal shape position, wherein the profile is specific to the user, wherein the profile is based on measurements made of the user while the user was standing in a relaxed position, wherein the measurements are based on an interaction of a body of the user and a mattress, wherein the measurements are made by applying a force to a user, wherein the force is based on a body mass distribution of the user, wherein the profile forms a support surface; a first end; a second end separate, wherein a length of the two or more members is between the first end and the second end; wherein the two or more members comprise two or more portions, wherein each portion has a width that is less than the length of the member, and wherein each portion includes a predetermined angle and a predetermine height from the bearing surface, wherein the angle and height of each of the portions forms the profile; two or more slats, wherein each slat is affixed to the first side of two or more members, wherein each of the slats spans the distance between the two or more members, wherein a top of the slat forms a first sleep surface, and wherein each slat has a width substantially similar to the width of the portion; a mattress placed upon the two or more slats, wherein a top of the mattress forms a second sleep surface; wherein the user sleeps on one of the first or second sleep surface with a head of the user at the second end and a foot of the user at the second end; and wherein the first or second sleep surfaces maintains a spine of the user in the low-stress neutral spinal shape position.

Embodiments include a sleep system, comprising: a first section; a second section attached to the first second at a pivot, wherein the second section rotates at the pivot with respect to the first section; wherein each of the first section and the second section comprises: two or more members separated by a distance, each member comprising: a second side, wherein at least a portion of the second side rests on a bearing surface; a first side, wherein a profile is formed in the first side, wherein the profile forms a support surface for the sleep system; a first end; a second end separate, wherein a length of the two or more members is between the first end and the second end, and wherein the length of the two or more members is less than a total height of the user; wherein the two or more members comprise two or more portions, wherein each portion has a width that is less than the length of the member, and wherein each portion includes a predetermined angle and a predetermine height from the second side, wherein the angle and height of each of the portions forms the profile; two or more slats, wherein each slat is affixed to the first side of two or more members of each section, wherein each of the slats spans the distance between the two or more members, wherein a top of the slat forms a first sleep surface, and wherein each slat has a width substantially similar to the width of the portion; a mattress placed upon the two or more slats of each section, wherein a top of the mattress forms a second sleep surface; wherein the user sleeps on one of the first or second sleep surface with a head of the user at the second end and a foot of the user at the second end; wherein by rotating the second section with respect to the first second adjusts the second sleep surface between a first profile and a second profile; wherein the first profile maintains a spine of the user in a first low-stress neutral spinal shape position when the user sleeps on a side; and wherein the second profile maintains a spine of the user in a second low-stress neutral spinal shape position when the user sleeps on a back.

Embodiments include a method for constructing a configurable bed, comprising: positioning a user in a standing posture; determining a size for a portion; determining a position of the portion, wherein the position of the portion is associated with a body segment of the user; determining a body mass of the body segment at the position; measuring a force at the position of the user; applying the force at the position; measuring an angle at the position; measuring a distance at the position; approximating a profile for a support surface of the configurable bed; and constructing the configurable bed that includes the support surface having a profile based on the angle measurement and the distance measurement.

An aspect of the above method includes wherein the user has a low-stress natural spine shape in the standing posture.

An aspect of the above method includes wherein the profile of the configurable bed maintains the low-stress natural spine shape.

An aspect of the above method includes wherein the profile forms the support surface for the configurable bed.

An aspect of the above method includes wherein the configurable bed includes two or more of the portions, wherein each portion has a width that is less than a length of the configurable bed, and wherein the two or more portions form the profile.

An aspect of the above method includes wherein each portion includes the angle.

An aspect of the above method includes wherein each portion includes a height from a bearing surface based on the distance.

An aspect of the above method includes wherein the force is based on a required force to support the body segment of the user that at the position.

An aspect of the above method includes wherein constructing the configurable bed comprises: constructing one or more members, each member comprising: a second side that rests on the bearing surface; and a first side, wherein the profile is formed in the first side, wherein the profile forms a support surface for the configurable bed.

An aspect of the above method includes wherein constructing the configurable bed comprises constructing two or more slats, each slat affixed to the first side of two or more members, wherein the slat spans between two or more members, wherein a top of the slat forms a first sleep surface.

An aspect of the above method includes wherein each slat has a width substantially similar to the width of the portion.

An aspect of the above method includes wherein constructing the configurable bed comprises placing a mattress upon the two or more slats.

An aspect of the above method includes wherein a top of the mattress forms a second sleep surface.

An aspect of the above method includes wherein the two or more members include a raised section formed to support the head of the user.

An aspect of the above method includes wherein the body mass at each portion forms a body mass distribution.

An aspect of the above method includes wherein the distance is measured from a predetermined location to a body of the user.

An aspect of the above method includes wherein the profile is measured for one of a side of the user or a back of the user.

An aspect of the above method includes wherein the profile is measured with the mattress placed against the body of the user.

Embodiments include a method for constructing a configurable bed, comprising: positioning a user in a standing posture with a low-stress natural spinal shape; placing a mattress against a body of the user; determining a size for each of two or more portions; determining a position for each of the two or more portions, wherein each position of each of the portions is associated with a body segment of the user; determining a body mass of the body segment at each of the positions; measuring a force at each of the positions of the user; applying the force at each of the positions; measuring an angle at each of the positions; measuring a distance at each of the positions; and constructing the configurable bed that includes a support surface having a profile based on the angle measurement and the distance measurement of each of the two or more portions.

Embodiments include a non-transitory computer readable medium executed by a process causing the processor to execute instructions for a method for designing a configurable bed, the method comprising: determining a size for each of two or more portions, wherein a portion is associated with a user in a standing posture with a low-stress natural spinal shape; determining a position for each of the two or more portions, wherein each position of each of the portions is associated with a body segment of the user; determining a body mass of the body segment at each of the positions; measuring a force at each of the positions of the user; instructing a measurement apparatus to apply the force at each of the positions; measuring an angle at each of the positions; measuring a distance at each of the positions; and designing a support surface of the configurable, wherein the support surface has a profile based on the angle measurement and the distance measurement of each of the two or more portions.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The term "automatic" and variations thereof, as used herein, refers to any process or operation done without material human input when the process or operation is performed. However, a process or operation can be automatic, even though performance of the process or operation uses material or immaterial human input, if the input is received before performance of the process or operation. Human input is deemed to be material if such input influences how the process or operation will be performed. Human input that consents to the performance of the process or operation is not deemed to be "material."

The term "computer-readable medium," as used herein, refers to any tangible storage and/or transmission medium that participate in providing instructions to a processor for execution. Such a medium may take many forms, including but not limited to, non-volatile media and/or volatile media. Non-volatile media includes, for example, NVRAM, or magnetic or optical disks. Volatile media includes dynamic memory, such as main memory. Common forms of computer-readable media include, for example, a floppy disk, a flexible disk, hard disk, magnetic tape, or any other magnetic medium, magneto-optical medium, a CD-ROM, any other optical medium, punch cards, paper tape, any other physical medium with patterns of holes, a RAM, a PROM, and EPROM, a FLASH-EPROM, a solid state medium like a memory card, any other memory chip or cartridge, a carrier wave as described hereinafter, or any other medium from which a computer can read. A digital file attachment to e-mail or other self-contained information archive or set of archives is considered a distribution medium equivalent to a tangible storage medium. When the computer-readable media is configured as a database, it is to be understood that the database may be any type of database, such as relational, hierarchical, object-oriented, and/or the like. Accordingly, the disclosure is considered to include a tangible storage medium and prior art-recognized equivalents and successor media, in which the software implementations of the present disclosure are stored.

The term "module," as used herein, refers to any known or later developed hardware, software, firmware, artificial intelligence, fuzzy logic, or combination of hardware and software that is capable of performing the functionality associated with that element.

The terms "determine," "calculate", and "compute," and variations thereof, as used herein, are used interchangeably and include any type of methodology, process, mathematical operation or technique.

It shall be understood that the term "means," as used herein, shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

The term "user" can refer to an individual for whom the customized sleep system is created.

The term "sleep system" may refer to a system for improved quality of sleep that may include a sleep surface, a mattress, and other features.

The term "mattress" can refer to any cushioning or other material that can include one or more layers of compliant material. Each layer of material can have the same or different physical properties. For example, a first layer may be a first density, and second layer may have a second density.

The term "support" can refer to a vertical position of a support surface or a sleep surface maintained for each body segment when the user lies on the sleep surface.

The term "support surface" can refer to a two-dimensional or three-dimensional surface that the user sleeps upon or upon which a mattress is placed. The support surface can be a non-compliant surface (i.e., rigid) with a substantially curved shape or profile upon which rests a mattress or the user. The shape of the support surface may be based on individualized measurements of the user and/or the interaction between a user and a particular mattress to provide the desired support for the user.

The term "sleep surface," can refer to a two-dimensional or three-dimensional surface that may be formed by the support surface and a mattress or by the support surface alone, if no mattress is used. The sleep surface can maintain the user's spine in a low-stress neutral spine shape.

The term "body mass distribution" can refer to the mass of multiple cross sectional volumes (i.e., from side to side) of a body (e.g., body segments) distributed in the longitudinal direction (i.e., distributed from a person's head to the person's toes).

The term "low-stress neutral spinal shape" (LSNSS) can refer to the position or shape of the spine that will result in minimal or lesser physical stresses within and near the spinal vertebrae, vertebral disks, supporting muscles, and/or connective tissue when a person is prone and sleeping either on the person's side, back, or, possibly, front. Physical stress can include one or more of, but is not limited to, compressive, tensile, or shear stresses on and/or inside the user's body. The LSNSS may be approximated by the spinal shape of a user when the user is in a relaxed standing position.

The term "body segment" can refer to a portion of the human body. The human body may be divided into multiple body segments along the longitudinal direction. The body segments can be of equal or variable lengths. The body segments may be defined for analysis purposes to determine the user's body mass distribution and or LSNSS.

The term "support curve measurement device" (SCMD) can refer to a measurement device that may determine the shape of the support surface for an individual user and/or mattress combination.

The term "profile" can refer to the two-dimensional or three-dimensional shape of the support surface that can be measured and is associated with the particular user. The profile can also be called a "support curve" or "support profile". Generally, the profile approximates the shape of the support surface by measuring a user and/or the interaction between the user's body and a particular mattress at several locations along their body and/or the mattress using several forces associated with the body mass of a body segment at the location of the measurement. The measurements are generally taken while the user is standing in a relaxed position. The measurements ensure that the profile can best approximate the correct shape needed for a support surface to maintain the user's spine in an LSNSS position.

The term "portion" can refer to a section of the support surface that has predetermined and particular characteristics. Generally, the support surface can be separated or configured from two or more portions. The more portions that are present, the more detailed the profile of the support surface. Each portion can have characteristics, such as, one or more heights of the support surface at the portion location, one or more angles of the support surface at the portion location, etc. The characteristics of the portions, when the portions are combined to form the support surface, help to form the profile of the support surface.

The preceding is a simplified summary of the disclosure to provide an understanding of some aspects of the disclosure. This summary is neither an extensive nor exhaustive overview of the disclosure and its various aspects, embodiments, and/or configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and/or configurations of the disclosure are possible utilizing, alone or in combination, one or more of the features set forth above or described in detail below.

In the appended figures, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference label.

DETAILED DESCRIPTION

Presented herein are embodiments of a configurable bed. The configurable bed can include a support surface that is individualized for each user. The support surface may be created based on a profile. The profile, of the support surface, may be can be configured for a user 112 or a combination of a user 112 and a mattress 120. Generally, the support surface is determined by measuring the interaction between the user 112, or the user 112 and the mattress 124, and the body mass distribution of the user 112. The profile of the support surface may help to maintain a user's spine in a LSNSS position, as when the user is standing in a relaxed position.

Figure 1A:
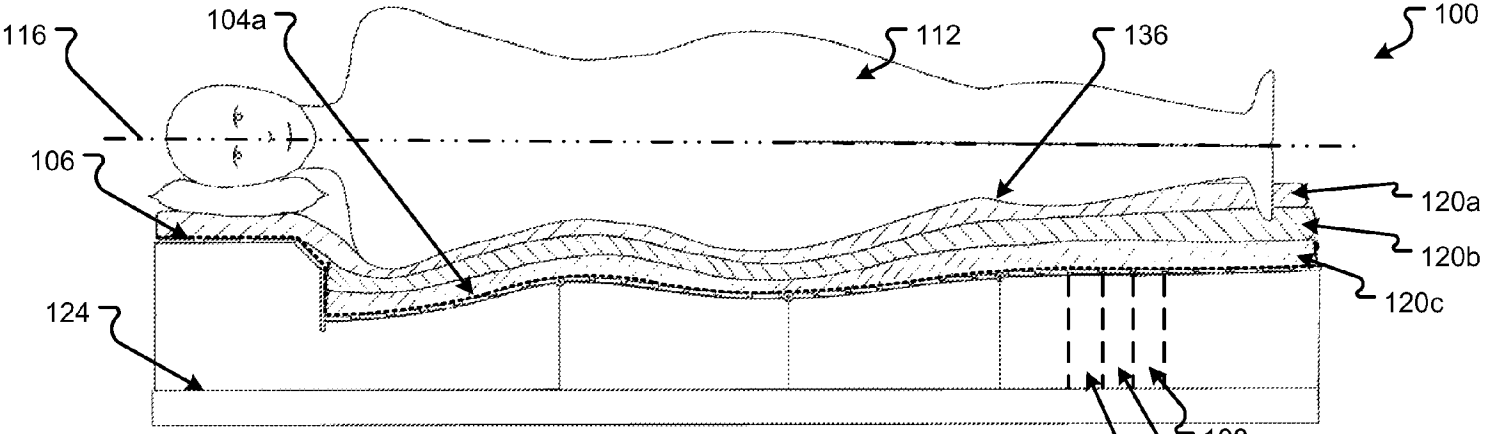
FIGS. 1A and 1B are representations of an embodiment of a configurable bed.

Configurable Bed:

Several configurations for a sleep system or bed 100 are presented, in FIGS. 1A through 7D. All or part of the descriptions that applies to one of the configurations of the sleep system 100, presented with respect to one of the FIGS. 1A-7D, may also apply to any of the other configurations, presented in the other FIGS. 1A-7D. The bed 100 can include a support surface of 104 having a profile, represented by dotted line 106. The profile 106 can be a curvilinear shape forming a plane on which the user 112 sleeps. The support surface 104 may be formed from a single piece of material with the profile 106 formed into the top of the material. Alternatively or additionally, the profile 106 may be constructed from two or more portions 108 that may provide support for a user and can maintain the user's spine in LSNSS. The profile 106 of the support surface 104 can ensure that the user or sleeper 112 can maintain a low-stress alignment of the spine (as represented by line 116) and, with a mattress 120, can provide good support for the entire body to maintain a beneficial sleeping position with minimal pressure points. It should be noted that while the LSNSS position in FIGS. 1A and 1B is shown as a straight line (116), the LSNSS of some users may contain a curve. For example, a user with scoliosis may have an LSNSS that is curved or has a portion of the LSNSS that is curved when positioned on the bed 100 as shown in FIG. 1A and/or FIG. 1B.

Some configurations of the bed 100 can contain a mattress 120, which may be formed from a compliant material, which is placed on the support surface 104. One or more layers of the mattress 120 may be formed from one or more of, but not limited to, foam, latex foam, memory foam, inflatable sacks, etc. The padding of the mattress 120 can create a better comfort level for the sleeper 112. In other situations, the user 112 can lay upon the support surface 104 without the mattress 120. However, if a mattress 120 is used, the top of the mattress 136 is the sleep surface.

The profile 106 of the support surface 104 can be a curvilinear shape. The shape of the profile 106 may be formed as continuous or may be formed from two or more portions, e.g., 108*a*-108*c*. If portions 108 are used to approximate the profile 106, each portion 108 of the support surface 104 can have a particular configuration that is predicated on an angle or angles of that portion of the support surface 104 and a distance or distances from a bearing surface 124 to the support surface 104. These configurable parameters (i.e., the angle and/or distance) for the each portion 108 of the bed 100 can approximate a profile 106 for the support surface 104 and can ensure that as the person lays on the support surface 104 or sleep surface 136 that the user's spine may be maintained in LSNSS, as represented by line 116 shown in FIGS. 1A and 1B.

Figure 1B:
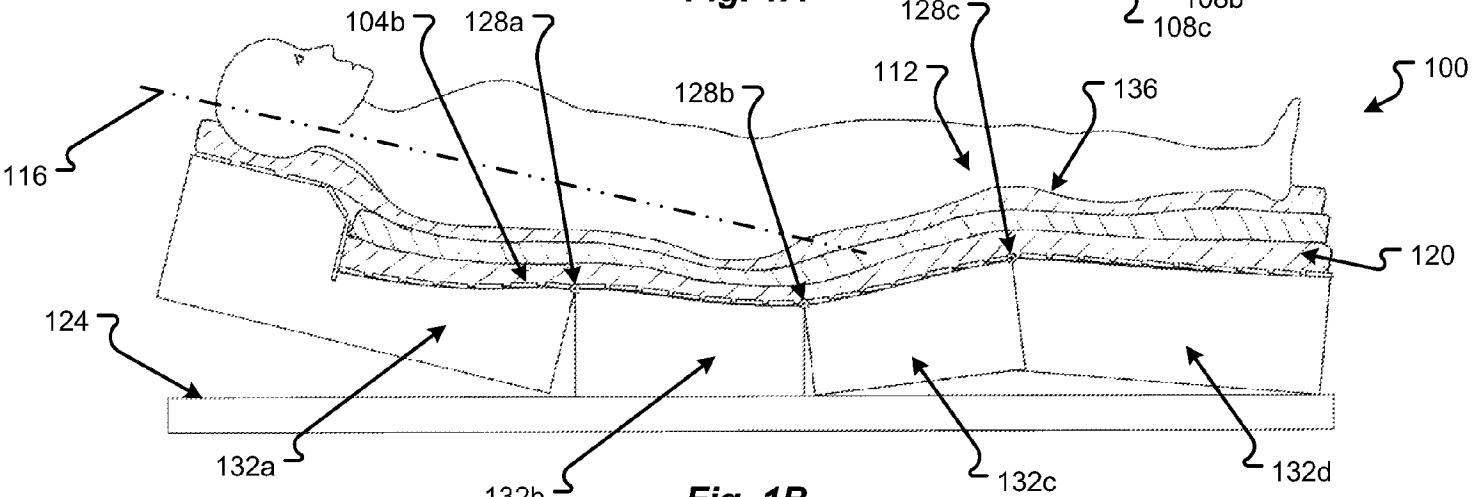

A configuration of the sleep system 100 used for people who primarily sleep on their "sides" is shown in FIG. 1A. A sleep system 100, as shown in FIG. 1B, may have one or more pivot points 128A, 128B, 128C, etc., that may rotate sections 132A, 132B, 132C, and 132D. The rotation of the section 132A-132D may allow the sleep system 100 to be reconfigured from a profile 106 104*a* for someone sleeping on their side, as shown in FIG. 1A, to a profile 106 104*b* that is suitable for someone sleeping on their back. In this way, the sleep system 100 may be configured, alternatively, for a sleeper 112 that may rotate or change position during the night. The reconfiguration of sleep system 100 can be manual or automatic. Thus, the user may be able to move the sections 132A-132D manually, or may have a controller that can actuate one or more motors that allow the one or more sections 132 to pivot along pivot points 128. The pivot points 128 may comprise a hinge, a rod, or some other rotatable mechanical or electromechanical connection between any of the two sections 132. Each section may be formed from a solid, rigid material (e.g., non-compliant foam or plastic) or may be constructed by two or more components.

Figure 2A:
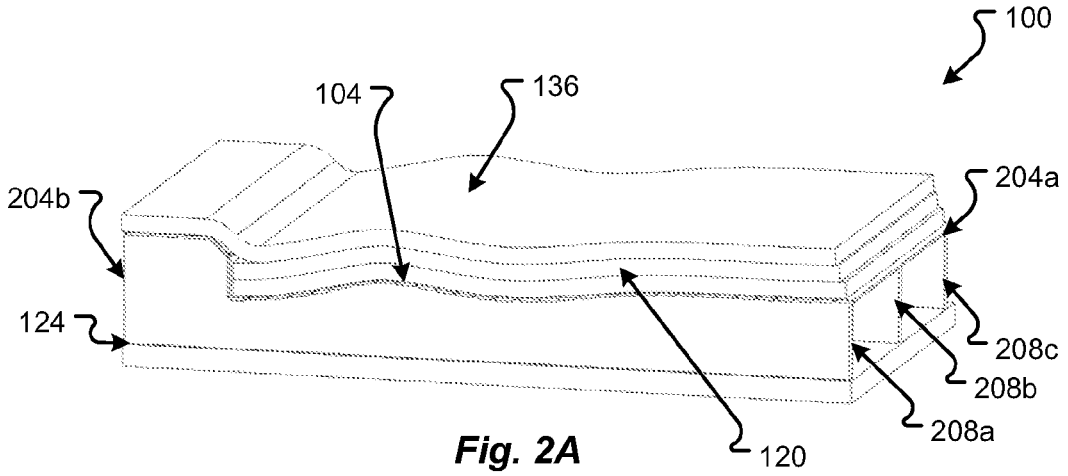
FIGS. 2A, 2B, and 2C are representations of an embodiment of a configurable bed.
Figure 2B:
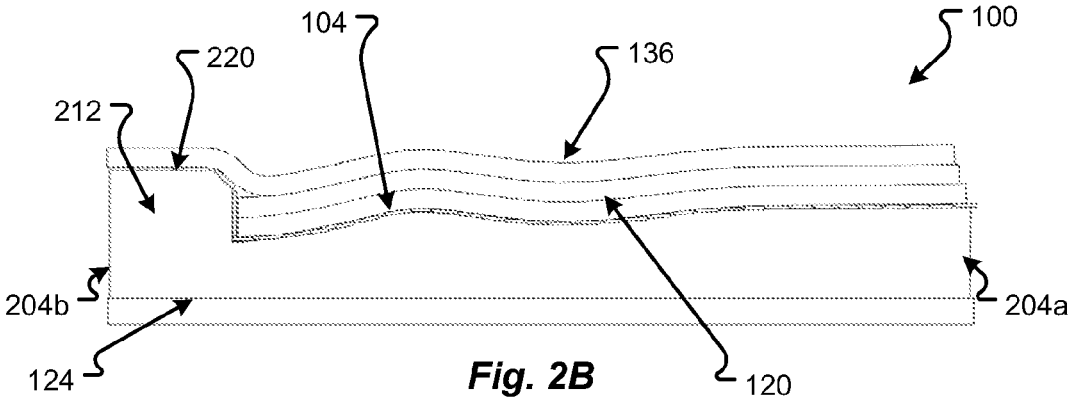
Figure 2C:
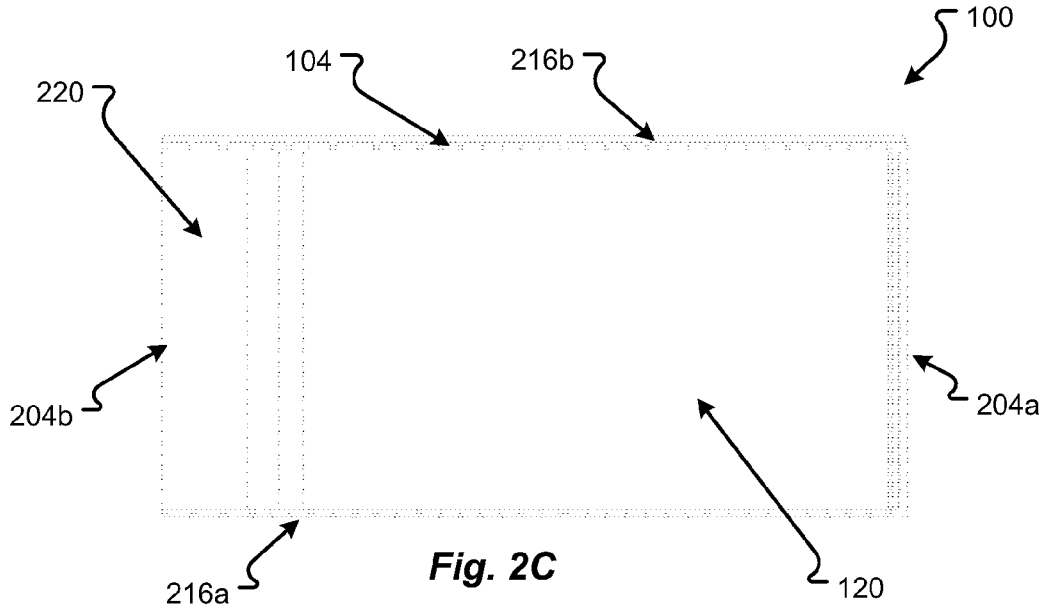

Another configuration for the sleep system 100, which may include many of the same elements, is shown in FIGS. 2A through 2C. The sleep system 100 may have a non-adjustable base 208 (in contrast to the movable sections 132 shown in FIG. 1) that may be constructed of one or more members 208*a*, 208*b*, and 208*c* (each member 208 may have a complex curve or curvilinear shape formed into it to form the profile 106 of the support surface 104). Each of the members 208 may be formed from a rigid and solid material (e.g., wood, steel, aluminum, etc.), which do not include pivot points 128. The sleep system 100 may be configured for either a sleeper 112 who sleeps primarily on their back or primarily on their side.

The sleep system 100 can also have a support surface 104 that is configured specifically for the person 112. The bed 100 may also have a mattress 120 that provides a cushion for the person 112 and forms the sleep surface 136. The profile 106 of the support surface 104, based on a measurement of an interaction between a force, which is based on the user's body mass distribution, and the user 112 or the combination of the user 112 and a mattress 120, may extend from a first end 204*a* to a second end 204*b* and from a first side 216*a* to a second side 216*b*. This measurement of the profile 106 can be made when the user is in the relaxed standing position to approximate a neutral and/or LSNSS position of the spine. The profile 106 of the support surface 104 ensures the proper and substantially neutral alignment of the spine of the sleeper 112. Optionally, the profile 106 can be formed from two or more portions 108*a*-108*c*. Each portion 108 may have a predetermined width, height, and other characteristics. Any number of portions 108 may be used to form the profile 106.

In the example shown in FIGS. 2A through 2C, the sleep system 100 can also include section 212, which may be raised or elevated from the bearing surface 124 to provide an extension of the sleep surface 216. The extension of the sleep surface 216 can provide a portion of the bed 100 that functions as a pillow or support for the head of the sleeper 112 (as shown in FIG. 1A). The raised section 212 is optional, as the user 112 may desire to use their own pillow or may not desire to use a pillow at all and sleep on the sleep system or bed 100 directly.

Figure 3A:
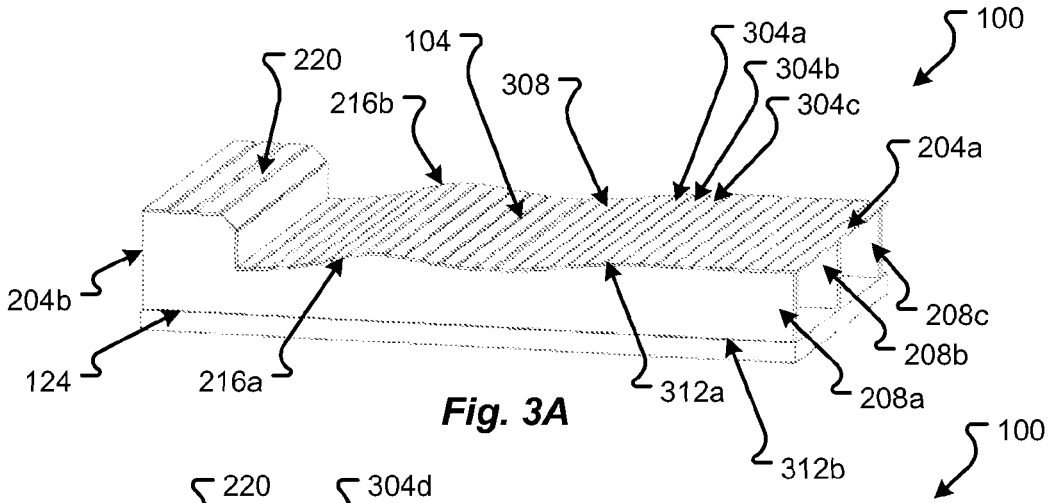
FIGS. 3A, 3B, 3C, 3D, 3E, and 3F are representations of an embodiment of a configurable bed.
Figure 3B:
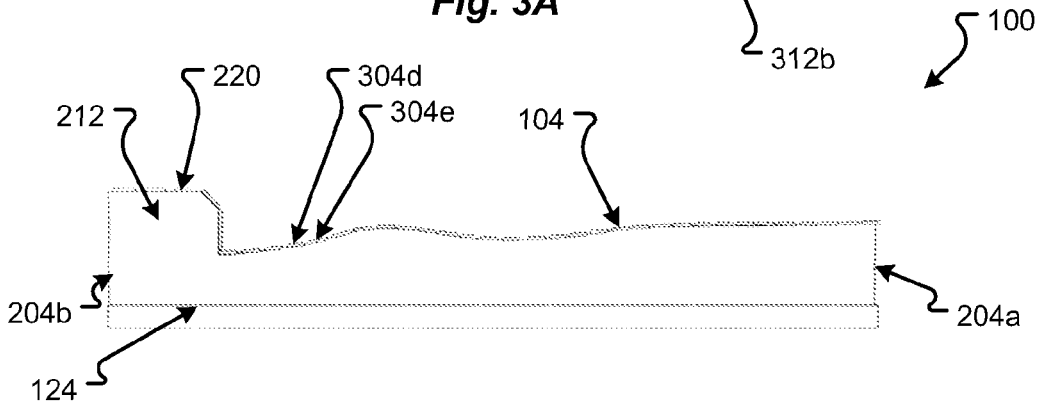
Figure 3C:
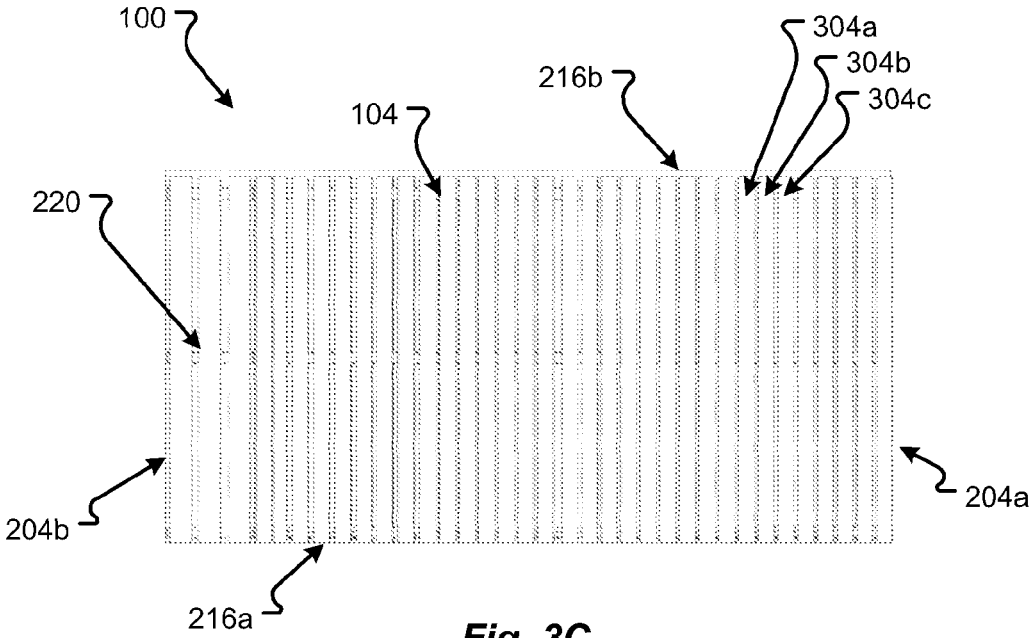
Figure 3D:
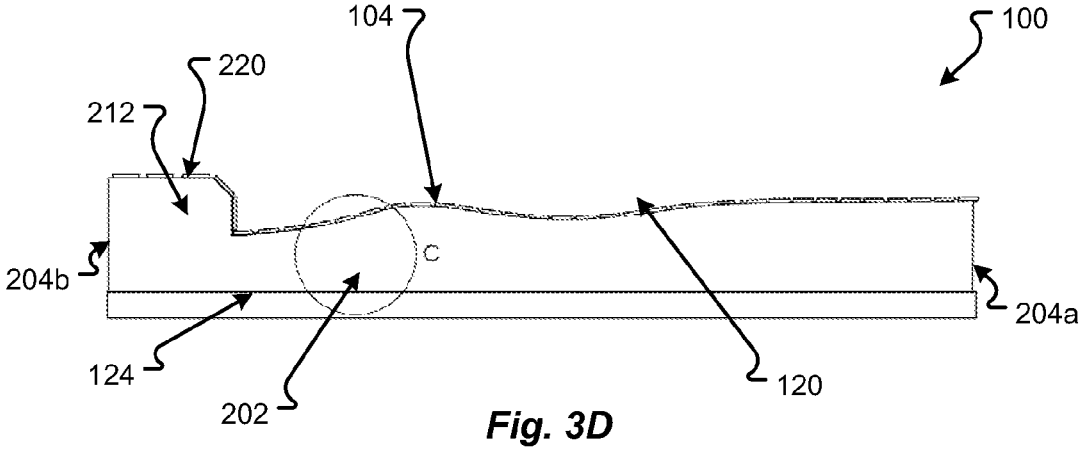

Another example or configuration of the sleep system or bed 100 is shown in FIGS. 3A-3F, which may include many of the same elements as the beds 100 shown in FIGS. 1A-2C but without the mattress 120. As shown in FIGS. 3A through 3C, the support surface 104, which may be the sleep surface in this configuration, may be sectioned into portions 108*a*, 108*b*, etc. The portions 108 may be sections or divisions of the support surface 104, where each portion 108 or each section can be configured differently.

In the examples shown in FIG. 3A through 3E, the support surface 104 may be formed from two or more slats 304*a*, 304*b*, and 304*c*, etc. The slats 304 may be a three dimensional construct that can have a length that extends substantially from a first side 216*a* of the bed 100 to the second side 216B of the bed 100. The slats 304 may have a width that can extend across at least a portion 108 of the bed 100 or across multiple portions 108 of the bed 100. The height of the slat 304 may be governed by the material type for the slat 304 and the required tensile, compressive strength, and stiffness/rigidity needed to support the user 112. Generally, the slat 304 is formed from a rigid or semi-rigid material, e.g., wood, metal, plastic, etc.

Figure 3E:
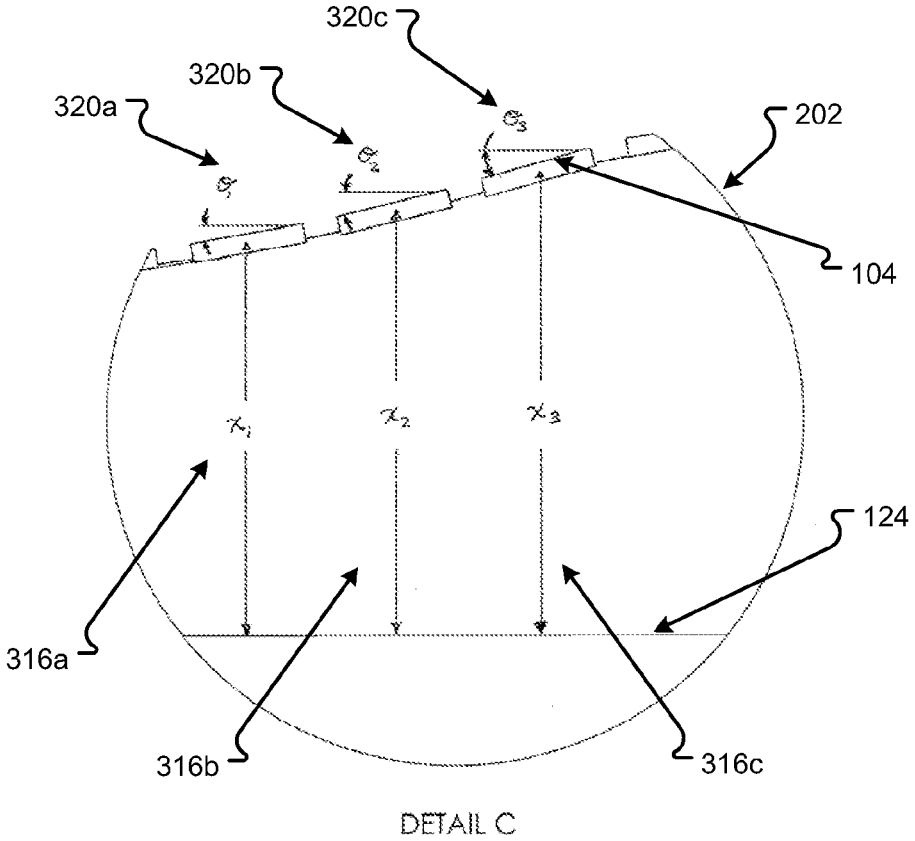
Figure 3F:
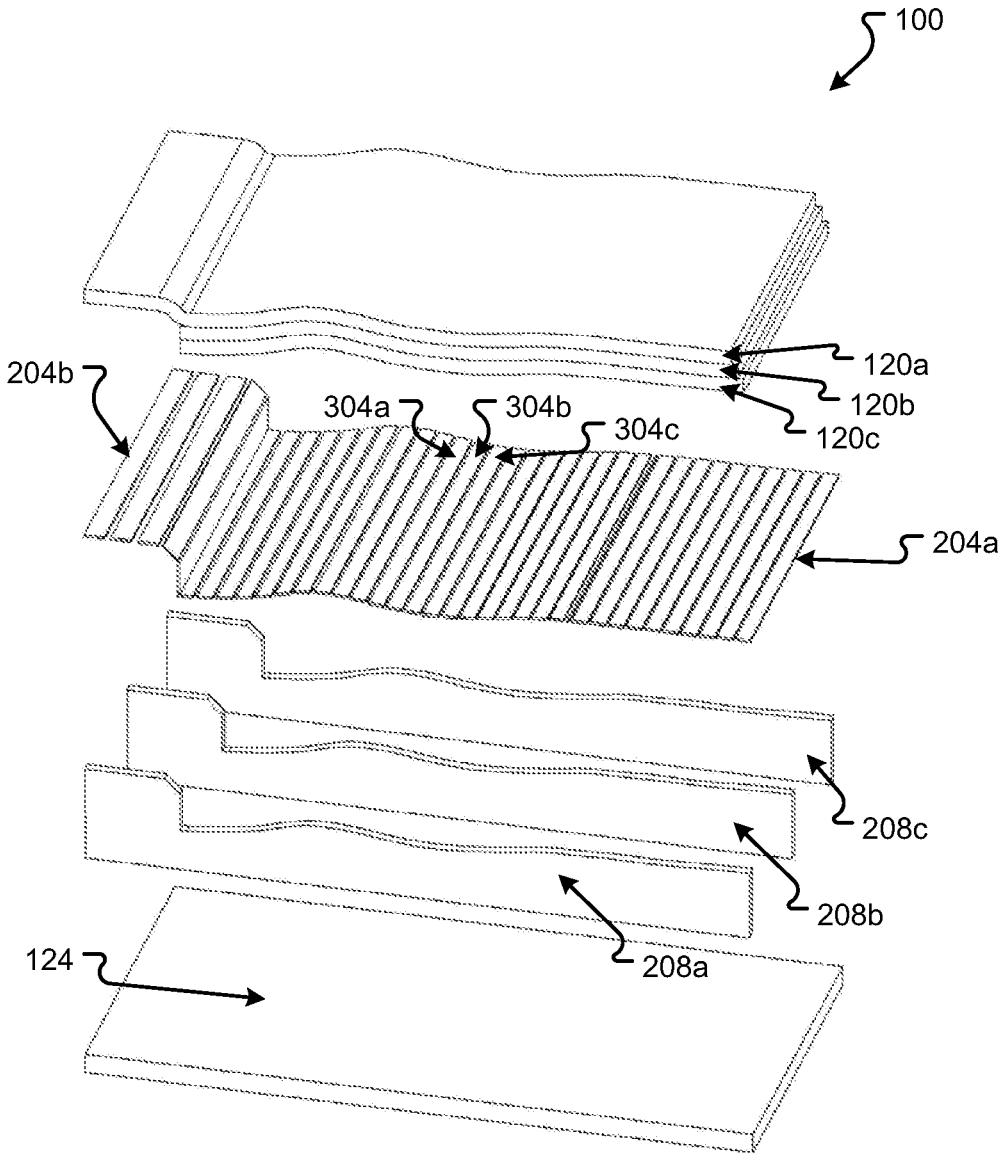
Figure 4A:
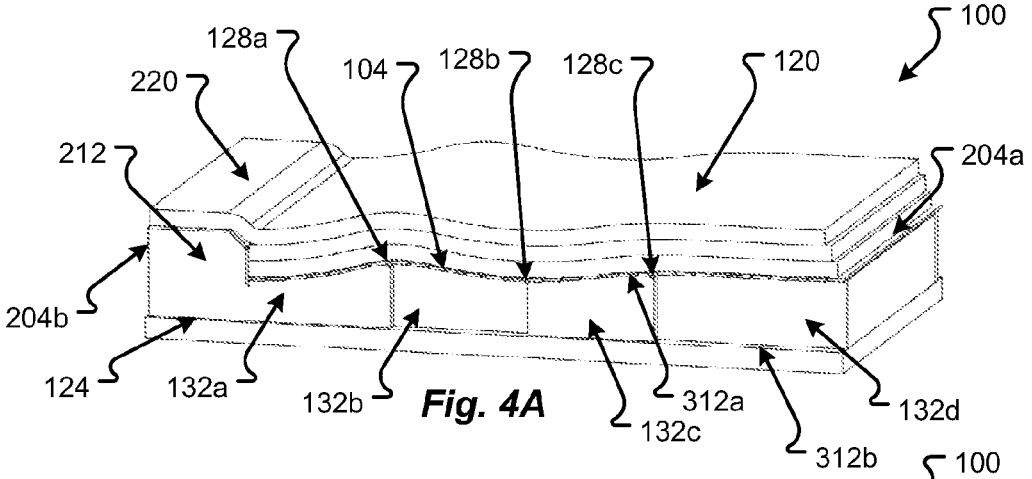
FIGS. 4A, 4B, and 4C are representations of an embodiment of a configurable bed.
Figure 4B:
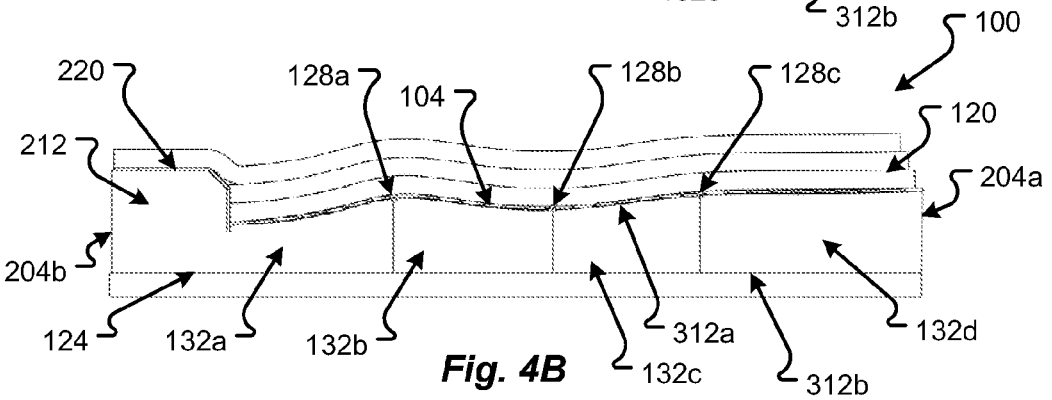
Figure 4C:
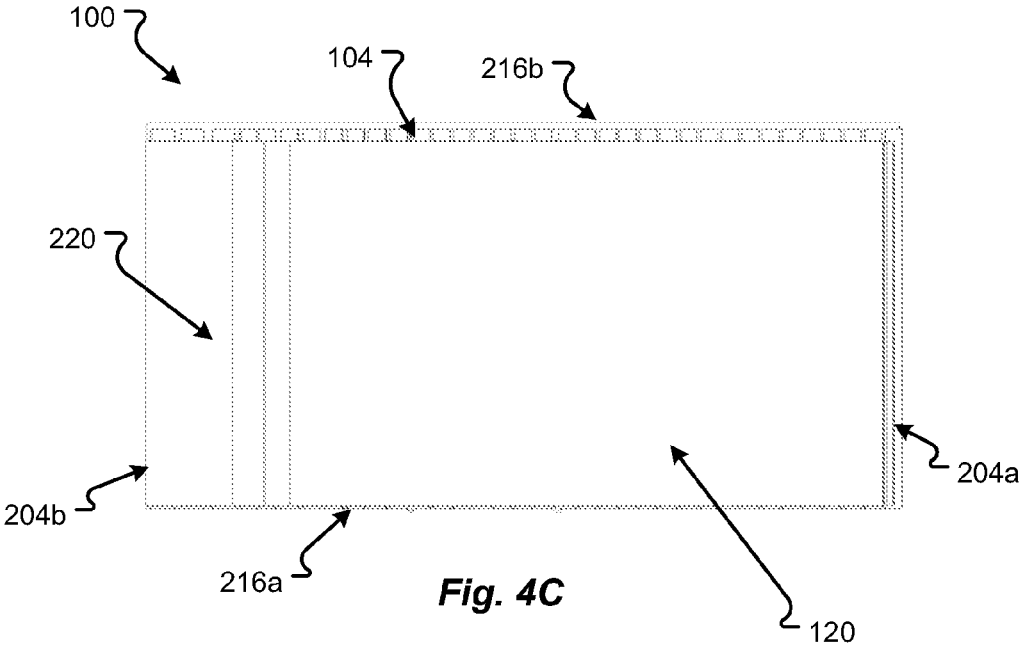
Figure 5A:
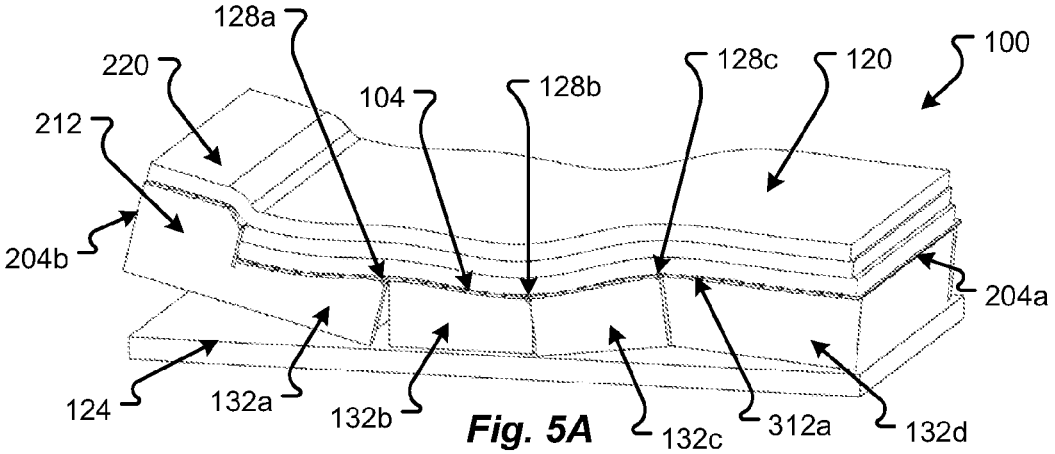
FIGS. 5A, 5B, and 5C are representations of an embodiment of a configurable bed.
Figure 5B:
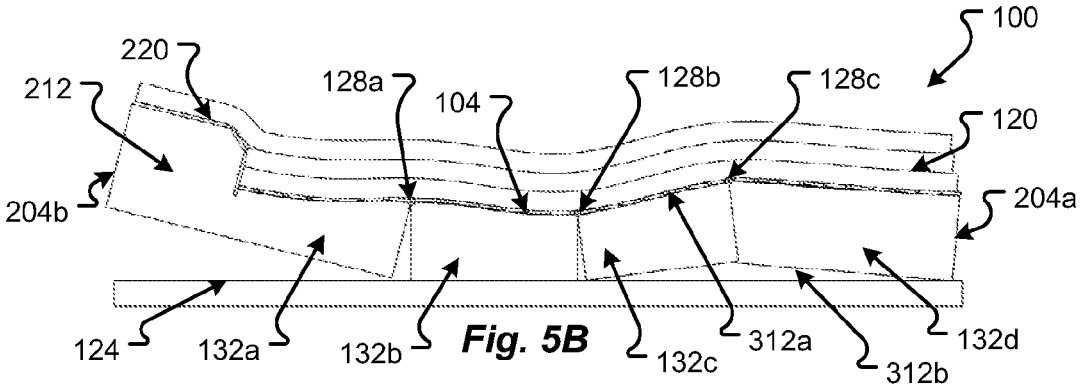
Figure 5C:
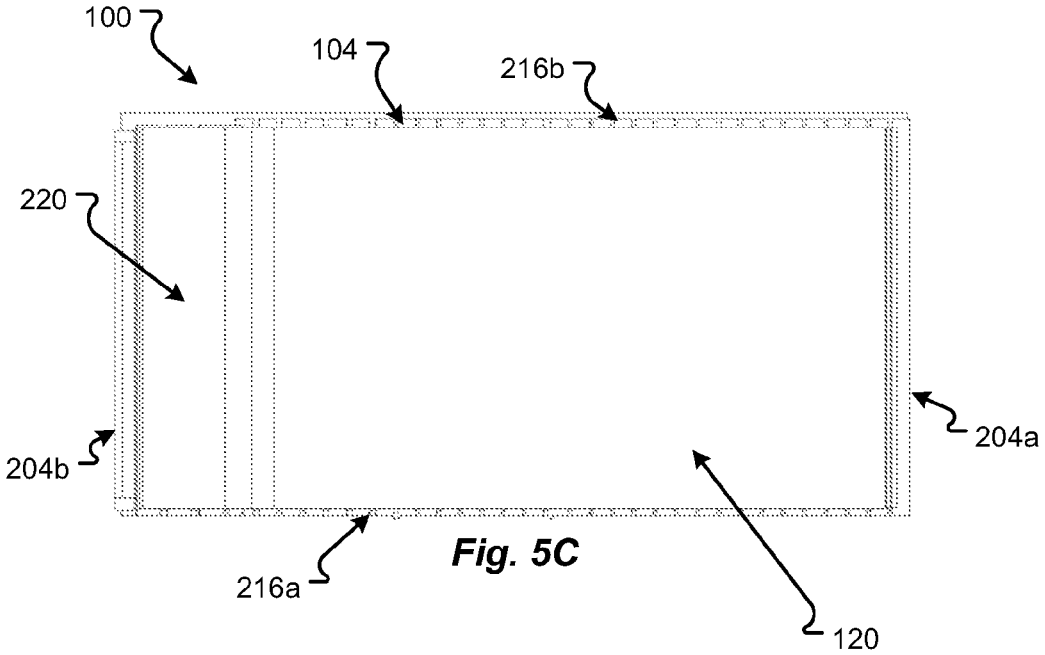

The slats 304 can have an angle of rotation along the length of the slat 304 that may not be parallel with the bearing surface 124. Further, as shown in FIG. 3E, surface 308 of the slat 304 can have a height measured from the side of the slat 304 forming the support surface 104 to the bearing surface 124. The angle and height of each slat 304 in each portion 108 can approximate, parallel, or create the profile 106 that is approximated by the support surface 104. The smaller the portions 108 the more detailed the profile 106 and the thinner the width of the slat 304 may be. In an alternative, the slats 304 may not be used but the support surface 104 is carved or formed into or from one or more solid, rigid pieces of material (e.g., block(s) of foam, plastic, wood, etc.).

The slats 304 may be mounted, affixed, and/or attached to one or more of the members 208*a* through 208*c*. Each member 208 can include a first end (substantially the same as end 204*a*) and a second end (substantially the same as end 204*b*). Further, each member 208 can include a first side 312*a* and a second side 312*b*. The members 208 may include the profile 106 formed on the first side 312*a*, and the second side 312 *b* can rest on the bearing surface 124. Thus, the members 208 support the weight of the user 112. Optionally, the user 112 may rest on one or more members 208 (if of sufficient width) without the slats 304 being employed. The members 208 may be one or more solid, rigid pieces of material (e.g., block(s) of foam, plastic, wood, etc.) extending from at least a portion of the distance from one side 216*a* to the second side 216*b* and from one end 204*a* to the other end 204*b* of the bed 100.

The slats 304 can provide the profile 106 formed by the configuration of each portion 108 to create the support surface 104 having the configuration associated with the sleeper 112. Generally, the profile 106 may be configured, carved, cut, or formed into the first side 312*a* of the member 208. The slats 304 may then be placed on the members 208 to form the support surface 104. Thus, the slats 304 that form the support surface 104 may substantially repeat the profile 106 from the shape of the member 208. Further, the materials for the member 208 may have a resistance to movement, but may be partially compliant, yet should keep the user's spine in a substantially neutral position. In alternatives, the members 208 may be configured as a box spring with the profile 106 formed in the first side 312*a* of the box spring.

The profile 106 can be generally formed by one or more distances x1-x3 316*a*-316*c* and/or one or more angles Θ1-Θ3 320*a*-320*c*. The distances x1-x3 316*a*-316*c* may be equal to or substantially similar to a distance from a bearing surface 124 to the support surface 104. The angles Θ1-Θ3 320*a*-320*c* may be an angle from horizontal or from a plane substantially parallel to the bearing surface 124. Each portion 108 may have different distances 316 and/or one or more angle(s) 320. The combination of the portions 108, with these different characteristics, can form the profile 106. Optionally, the profile 106 may also be formed by a series of two or more distances 316 that have an approximate curvilinear shape applied or fitted to the distances 316 as a "best fit" curve.

Figure 6A:
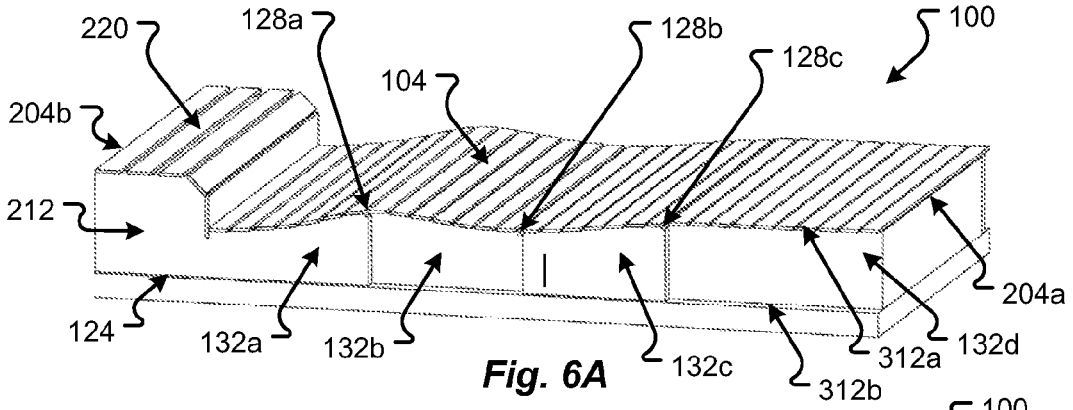
FIGS. 6A, 6B, 6C, 6D, 6E, 6F, and 6G are representations of an embodiment of a configurable bed.
Figure 6B:
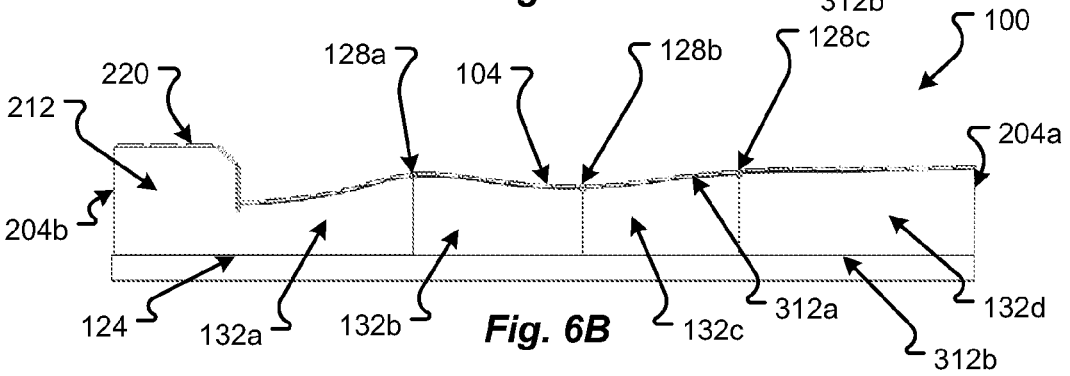
Figure 6C:
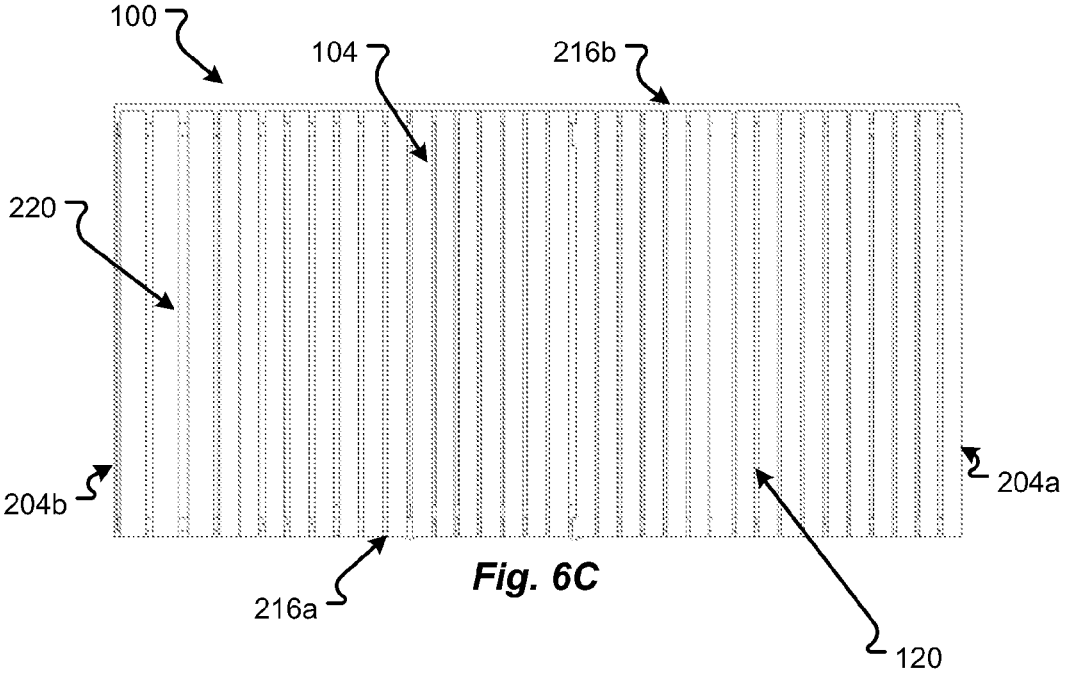

Another configuration for the bed 100 is shown in FIGS. 4A through 5C, and without a mattress 120, in FIGS. 6A through 6C. This configuration of the bed 100 is generally the same or similar to the configurations shown in FIGS. 1A and 1B. In this configuration, the bed 100 can include a support surface 104 that extends from a first end 204*a* to a second end 204*b*. Unlike some of the other configurations previously described, the bed 100 in FIGS. 4A-6C includes one or more adjustable sections 132 instead of member 208. The adjustable sections 132 allow the bed 100 to have a first profile 106 provided by the bed 100 when it is in the configuration shown in FIGS. 4A-4C and approximate a second profile provided by the bed 100 when it is in the configuration shown in FIGS. 5A-5C. Thus, the bed 100 provides a sleep surface 136 that can provide support for a user 112 that lies both on their side and on their back.

As explained previously, the sections 132 may be formed from a solid, rigid material (e.g., non-compliant foam or plastic) or may be constructed by two or more components (e.g., two or more support members 208 of shorter length and two or more slats, which generally form a box). The bed 100 may be adjusted for side and back sleepers. As an alternative, the profile 106 for the sleeper 112 in the side position (shown in FIG. 1A) may be formed in a first configuration (shown in FIGS. 4A-4C) of the support surface 104 and the profile 106 for the sleeper 112 in the back position (shown in FIG. 1B) may be formed in a second configuration (shown in FIGS. 5A-5C). As such, the user 112 may alternate configurations to adjust the bed 100 for their preferred sleeping position at that time.

Figure 6D:
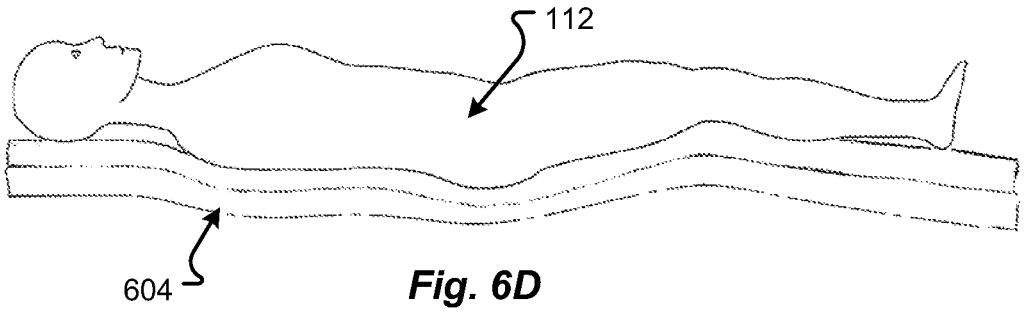
Figure 6E:
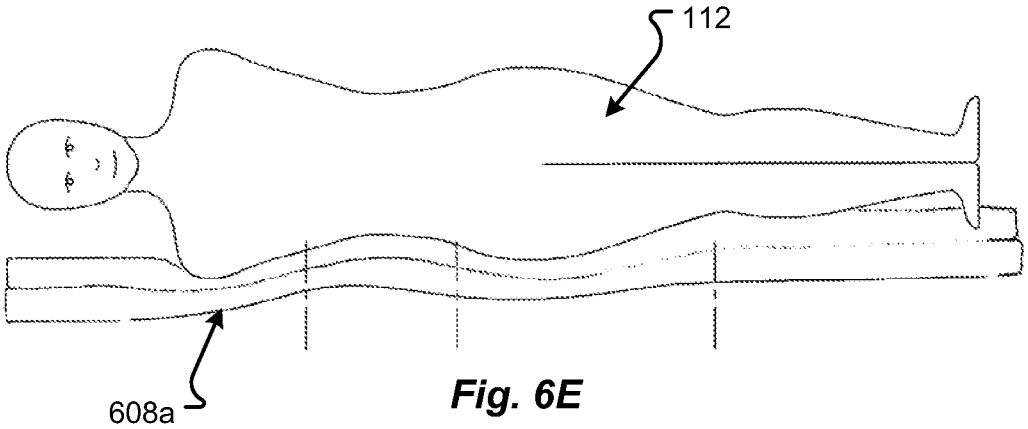
Figure 6F:
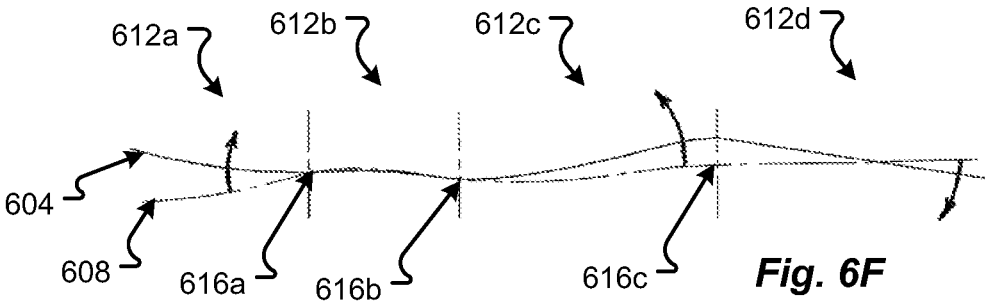
Figure 6G:
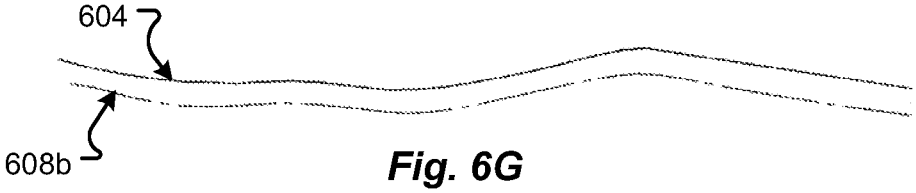
Figure 7A:
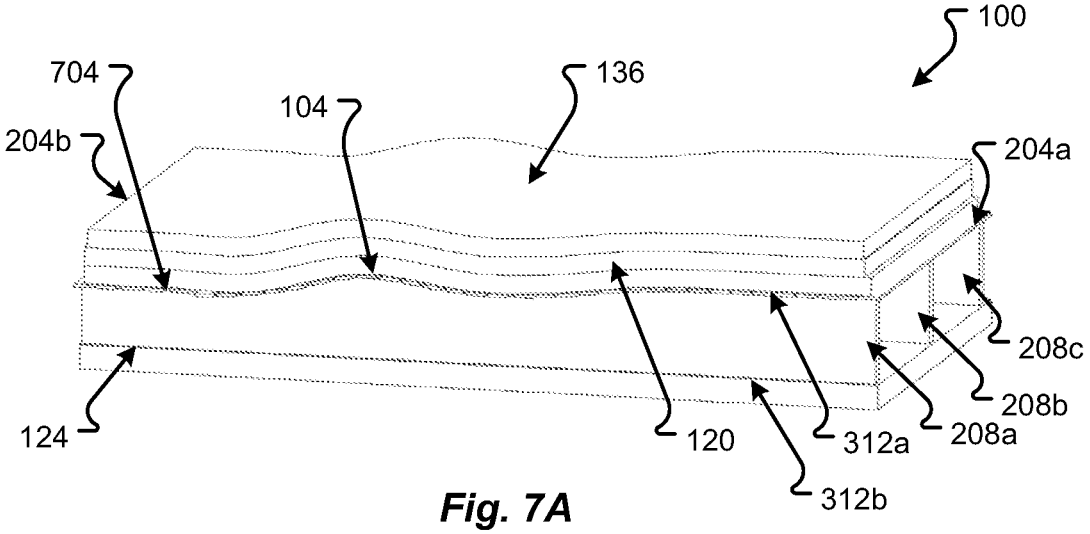
FIGS. 7A, 7B, 7C, and 7D are representations of an embodiment of a configurable bed.
Figure 7B:
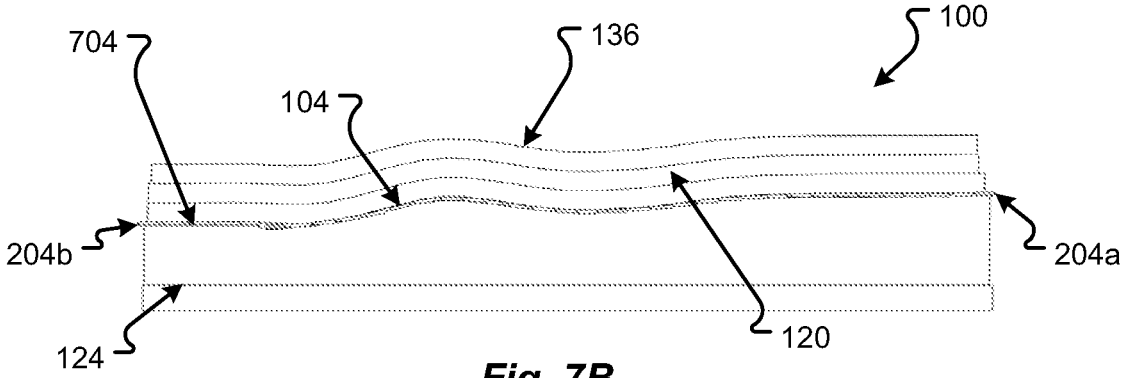
Figure 7C:
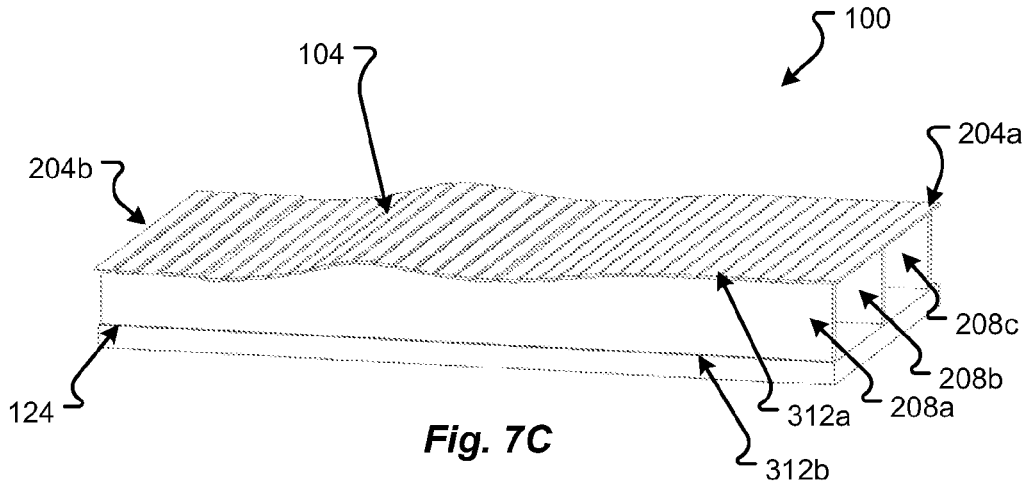
Figure 7D:
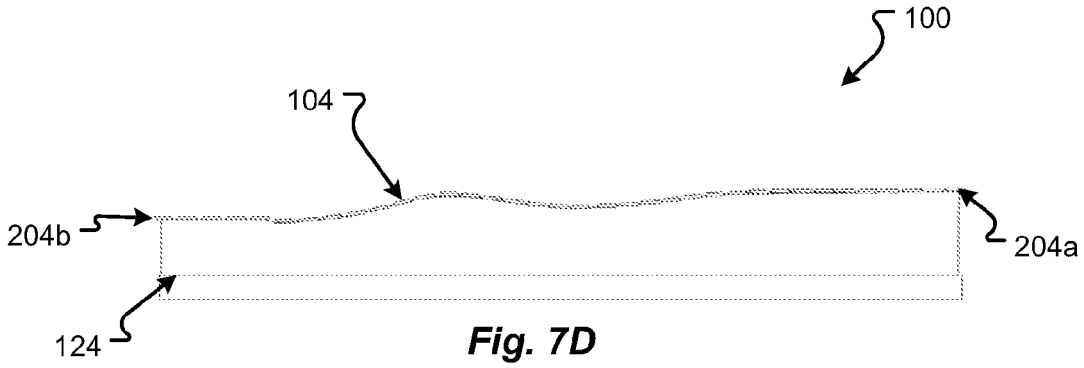

The alternative configurations are shown in FIGS. 6D through 6G. A first profile 604 for a user 112 may be measured for when the user 112 sleeps on their back, as shown in FIG. 6D. As second profile 608 can be measured for when the user 112 sleeps on their side, as shown in FIG. 6E. Then, the profile 608 may be divided into two or more segments 612*a*-612*d*. The segments 612 create different areas of the profile 608 that may be changed based on one or more rotation points 616*a*-616*c*. By moving the parts of the profile 608 in the sections 612 on or around the rotation points 616, the bed 100, shown in FIGS. 4A-6C can approximate the profile 604 for the user 112, when the user 112 is lying on their back. For example, FIG. 6G shows the profile 604 for the user 112, when they are laying on their back, and a profile 608*b* that shows the approximation created by rotating the profile 608*a* on or around the pivot points 616. It should be noted that the bed 100 may transition between the first configuration with profile 604 and the second configuration with profile 608 simply by the user moving from their back to their side and vice versa. In this way, the bed 100 transitions automatically simply by the movement of the user 112.

A configuration of the bed 100, shown in FIGS. 7A-7D, may not include section 212, which is an extension of the sleep surface 136 to provide support for a sleeper's head. Rather, portion 704 includes no extension allowing the user 112 to either use their own pillow or other sleep implement or sleep without a pillow or head support. In some configurations, the profile 106*s* used with sleepers that sleep on their back (see FIG. 1B) should not include section 212. Excluding section 212 and providing a section 704, without the extension for head support 216, provides the user 112 with a more beneficial and more appropriate support surface 104.

It should be noted that the mattress 120 may be formed from two or more layers 120*a*-120*c*, as shown in FIG. 1. One or more of the layers, e.g., 120*c*, may not span the entire length of the bed 100. Instead, the layer 120*c* may span from an end 204*a* of the bed 100 to the base of section 212. In this way, the upper layers, e.g., 120*a*, may be able to pass over the surface 220 without creating a large obstruction formed from sections of the mattress 120 at the base of section 212.

Figure 8:
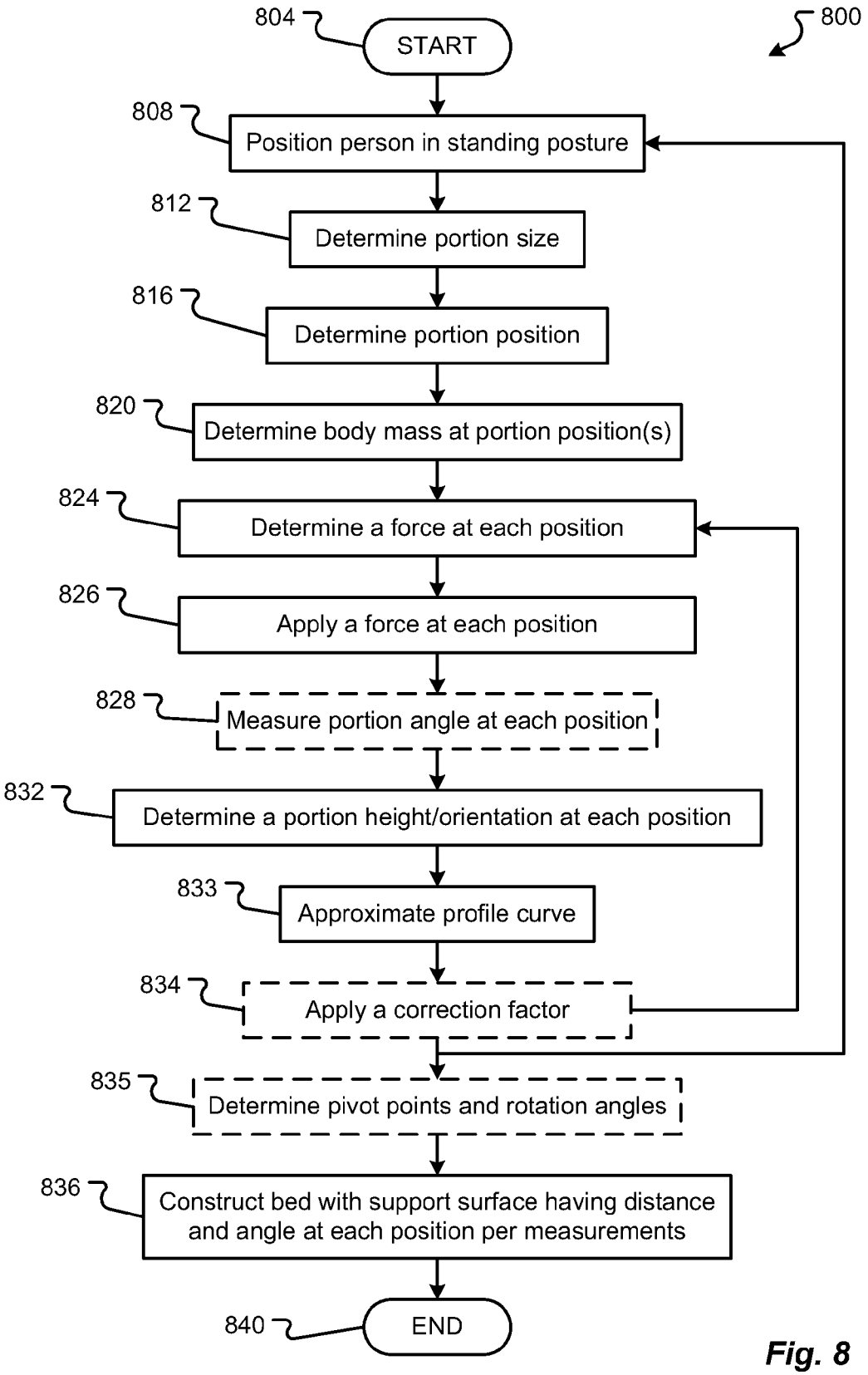
FIG. 8 is flow or process diagram of an embodiment of a method for determining a sleep surface for a user.

Bed Construction Process:

An embodiment of a method for constructing the beds 100, provided in FIGS. 1A through 7D, is shown in FIG. 8. Generally, the method 800 begins with a start operation 804 and terminates with an end operation 844. While a general order for the steps of the method 800 are shown in FIG. 8, the method 800 can include more or fewer steps or arrange the order of the steps differently than those shown in FIG. 8. At least a portion of the method 800 can be executed as a set of computer-executable instructions, executed by a computer system, and encoded or stored on a computer readable medium. Further, at least a portion of the method 800 can be executed by a sensor, a gate, or other hardware device or component that may be embodied in an Application Specific Integrated Circuit, a Field Programmable Gate Array, or other type of hardware device. Hereinafter, the method 800 shall be explained with reference to the systems, components, modules, software, data structures, etc. described in FIGS. 1A-7D and 9-23.

A person is positioned in a standing posture in a measurement apparatus (which may be as described in FIGS. 15 through 23), in step 808. Possibly the best method for approximating a user's LSNSS is when the user 112 is in a relaxed standing position. While standing, a person's spine is generally in a straight and/or neutral alignment similar to LSNSS. As such, all measurements of a user to create the profile 106 for the support surface 104 can be made while the person is standing. The LSNSS position can alleviate pain in the back caused by sleeping in a position where the spine is not in alignment.

With the person positioned for measurement in a standing position in a measurement apparatus, a profile may be determined. To measure the profile, the size of a portion 108 may be determined, in step 812. The portion size may be governed by how detailed the profile 106 for support surface 104 is. The width of the portions 108 and the number of portions 108 can be determined to provide the several portions 108 with cross-sectional widths to encompass the entirety of the support surface 104 from a first end of the bed 204*a* to a second end of the bed 204*b*. The portion width may be determined by the result of dividing the length of the support surface 104 (based on the height of the user) by the number of portions 108. Thus, the width of the portions 108 can be any size, for example 1", 2", 10 cm, etc. The portion width then can determine the position, configuration, shape, and size of the support surface 104.

A position of the two or more portions 108 may then be determined, in step 816. Here, the portion position may be determined by the height of a person 112 that is being measured. The first portion position may be provided at a foot of the person 112, or the top of the head of the person 112. Each portion position of an adjacent portion may then be determined along the entire length of the person 112. Thus, the profile 106 may be determined from a first to last portion position arranged from the proximal to distal end of a person 112.

For each portion 108, a body mass may be determined for the person 112 at that body segment or section 904, in step 820. For example, a body mass distribution can be determined by determining the body mass of two or more body segments 904 that are associated with the two or more portions 108. The body mass distribution can help determine how much force 908 may be applied in measuring the profile 106 at each portion 108, in step 824. The body mass may be determined by one of several methods, including algorithms that determine a cross-sectional mass based on the mass of the person, the body type of the person, or other characteristics of the person being measured. In other examples, a CT-scan, a three-dimensional laser scan, or other medical diagnostic equipment may be used to determine the mass of the person at section 904. Once the body mass is determined, the force "f", to be applied at each portion position, may be determined by determining how much force is needed to support (i.e., the force needed to counteract gravity) each body segment. The force may be directly related to the mass of the body segment which is based on the user's body mass distribution. However, the force may be modified by a factor or adjustment. The adjustment may vary depending on the location of the body segment. The factor can account for more or less support being needed at certain locations of the body (e.g., the hips, knees, shoulders, etc.), which can be associated with an adjustment required by a user 112 after testing a profile 106.

A force "f" 908*a* is applied to the body segment 904, in step 826. The force 908*a* may have a substantially equal and opposing force 908*b* (i.e., forces 908*a* and 908*b* are substantially symmetrical), which maintains the neutral spine position for the person 112 while being measured. The opposing forces 908*a* and 908*b* produces no net force on the user 122, while the user is being measure to ensure the user's spine maintains the LSNSS position. In some circumstances, the force 908 may be known and applied based on the body mass of the section 904.

The forces 908 can help to measure a profile 106 that is required to maintain the user's spine in a neutral and/or LSNSS position. The forces 908 may be applied directly to a person's side, back, front, etc. Optionally, one or more layers of a mattress 120 may be inserted between the user 112 and the element providing the force 908. The force 908 may be adjusted based on the body mass of the body segment 904 of the person 112 but may be applied to a combination of the mattress 916 and user 112. An element "E" 912 can apply the force to the body section 904 and function as the contact point between the measurement apparatus and the person 112 or mattress 916. Examples of different elements 912 are as shown in FIGS. 14A-14C and 19A-23. Thus, the measurement may be taken with any combination of a first force, a first force applying element 912, a first mattress 916, the user 112, a second mattress 916, a second force applying element 912, and a second force.

Figure 9:
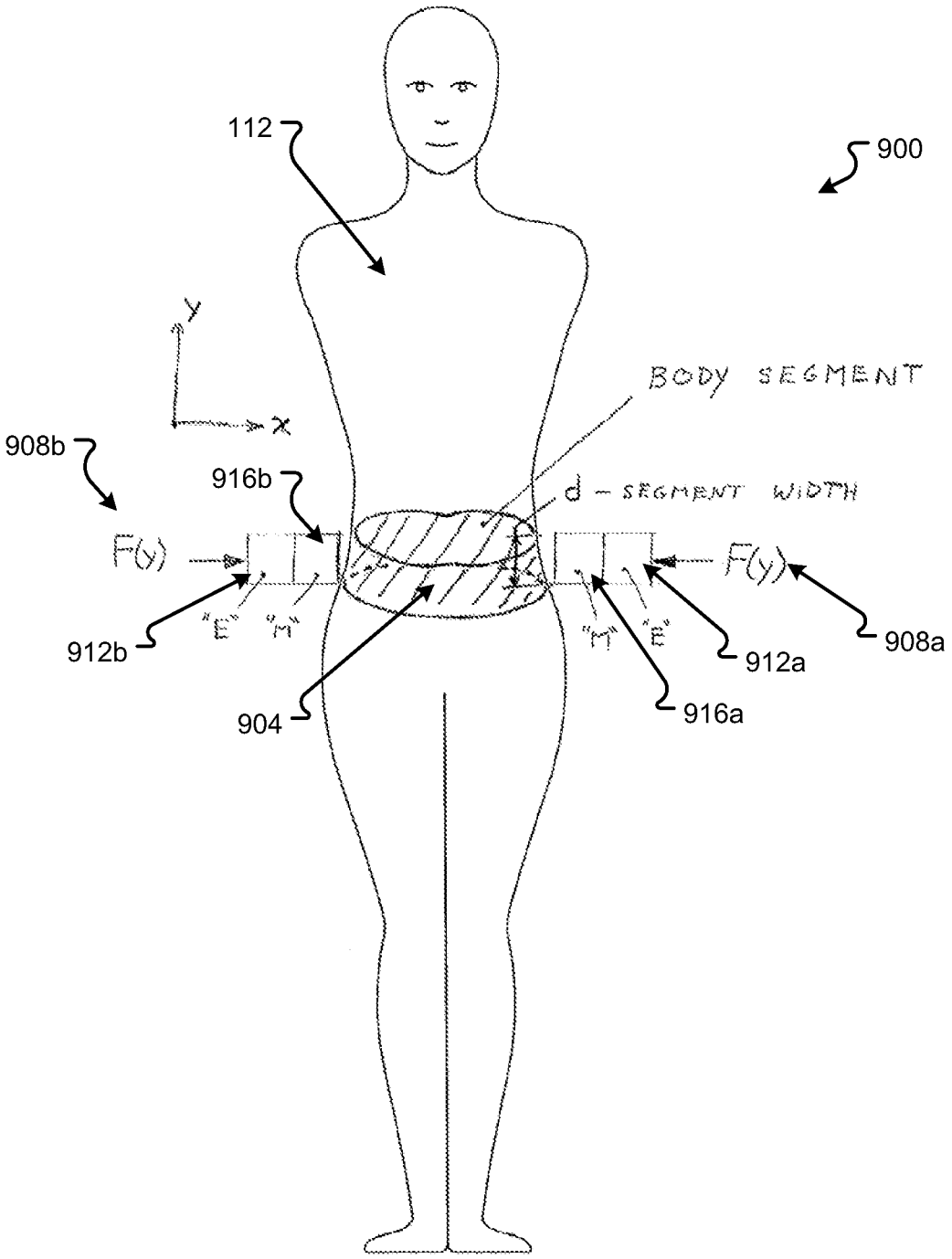
FIG. 9 is a diagram showing a body segment in a representative user and showing how a measurement of the user is made to determine the support surface.
Figure 11:
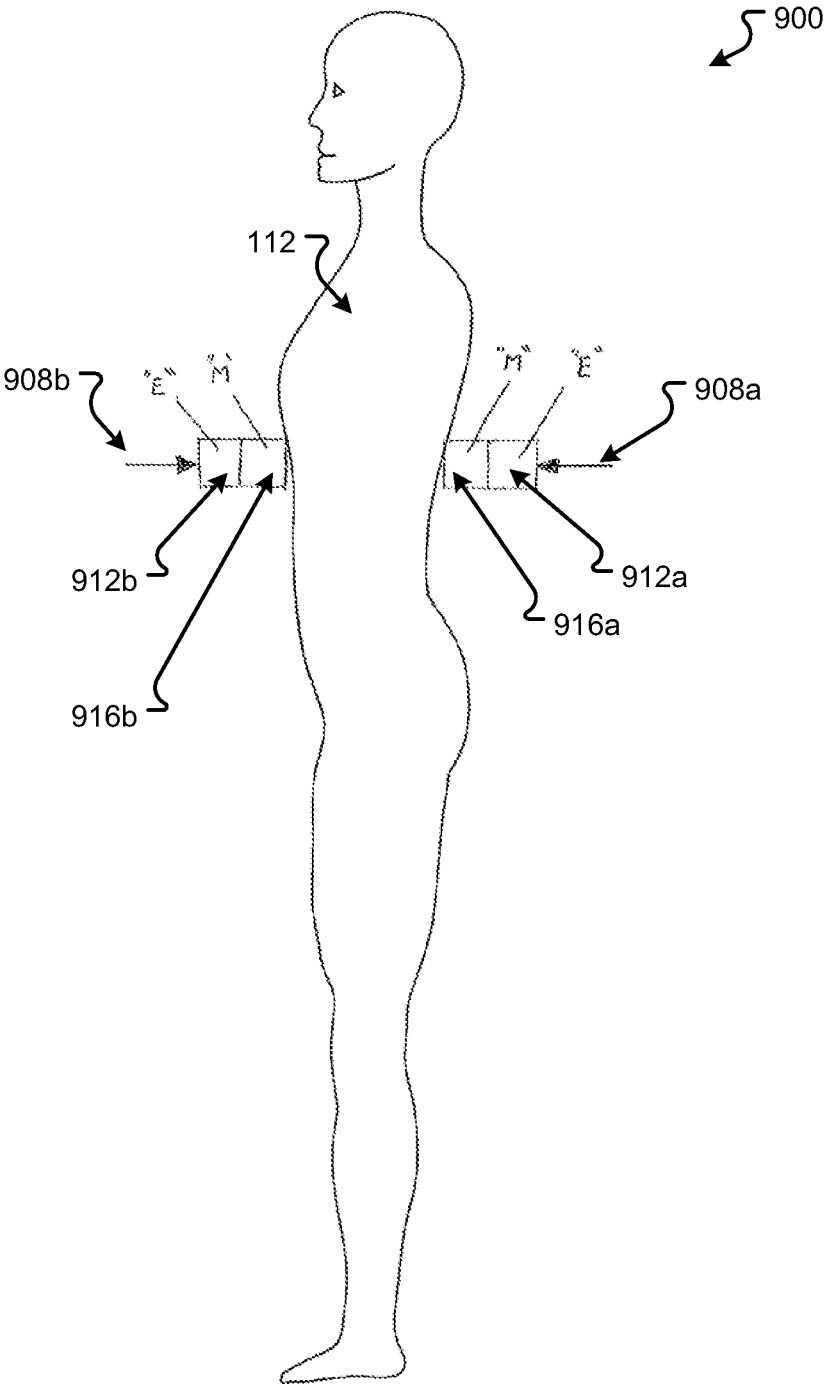
FIG. 11 is another diagram showing how a measurement of the user to determine the support surface profile is accomplished.
Figure 22:
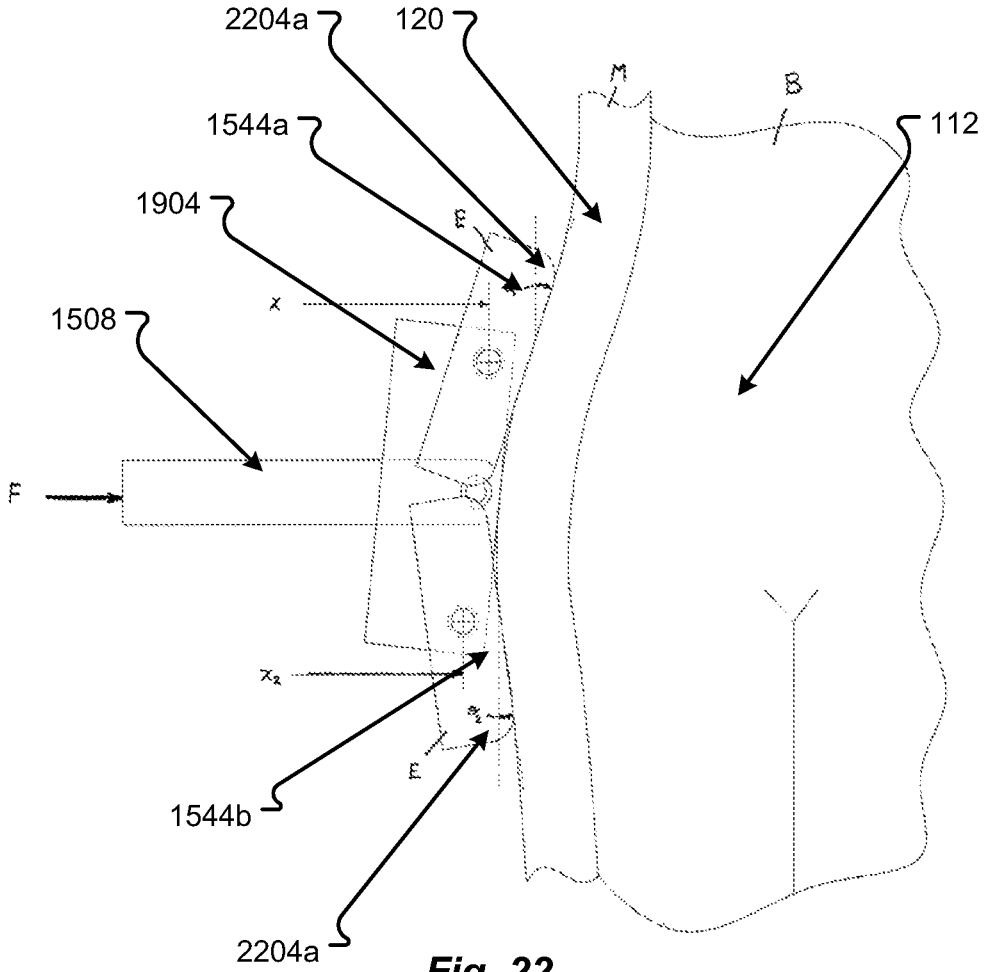
FIG. 22, which may be related to FIGS. 19A and 19B, is a representation of an embodiment of an element in a measurement system used to measure the profile of the support surface that corresponds to the user.

Optionally, upon the force 908 being applied, an element 912 may measure or conform to an angle for the body segment 904 or combination of the body segment 904 and mattress 916 at each portion position (which may be associated with a portion), in step 828. Here, the force 908 may be applied either to the sides of a person 112, as shown in FIG. 9, or to a front and/or back of a person 112, as shown in FIG. 11. The force 908 can push the element 912 towards the sides, back, or front of the person 112. Upon coming in contact with the person's side/front/back or the mattress 916, an angle 320 of the profile 104 at that portion position is determined. This determined angle 320 is associated with and becomes the angle 320 of the portion 108 forming the support surface 104. The determined or measure angle 2204*a*, 2204*b* may be as shown in FIG. 22.

Figure 10:
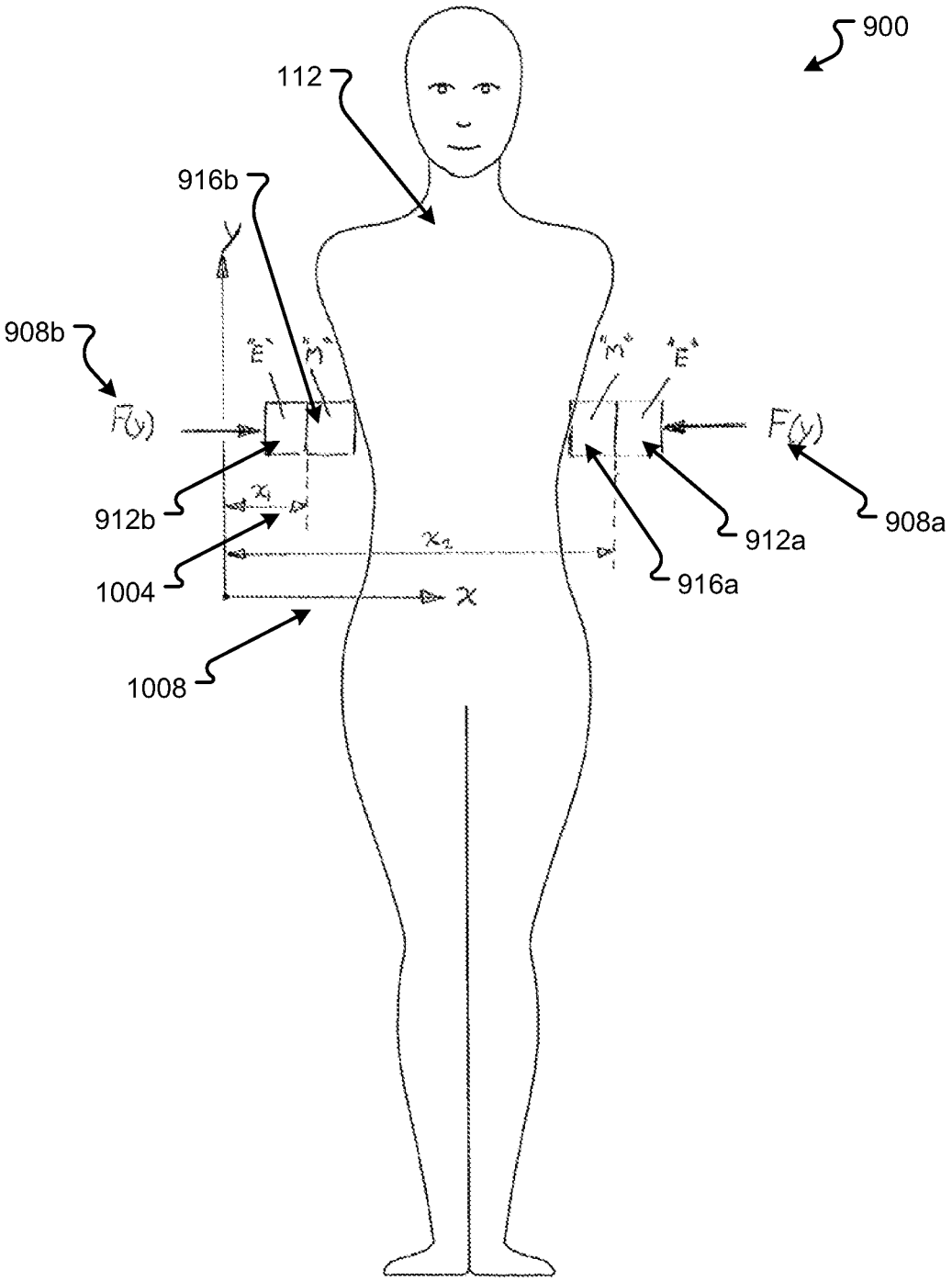
FIG. 10 is another diagram showing a body segment in a representative user and showing how a measurement of the user is made to determine the support surface profile.

The height 316 of the support surface 104, which is related to the orientation of an element 912 conforming to a possible support surface profile 106, is determined, in step 832. The height of the support surface 104 corresponds to the distance 316 from the bearing surface 124 to the support surface 104, as shown in FIG. 3E. Here, a distance 1004, x1 as shown in FIG. 10, is measured from a reference point to an end of element 912. Upon the element E 912 coming to rest (e.g., a condition of stasis where the force exerted against the person conforms to the needed force to support the person) against the mattress 916, the measurement of the horizontal distance 1004 from some known position y is measured and/or the orientation of the element 912 is recorded. This distance 1004 then becomes the distance 316 from a bearing surface 124 to profile 106. In this way, for each portion 108, a "height" of the support surface 104 is measured and can then be used to make the profile 106 of the support surface 104. The height x1 1004 ensures that a spine position of a user 112 can be maintained in the LSNSS position while the user 112 is sleeping. Optionally, if no mattress 120 is used on the bed 100, the measurement of the height may be taken without mattress 916.

Figure 12:
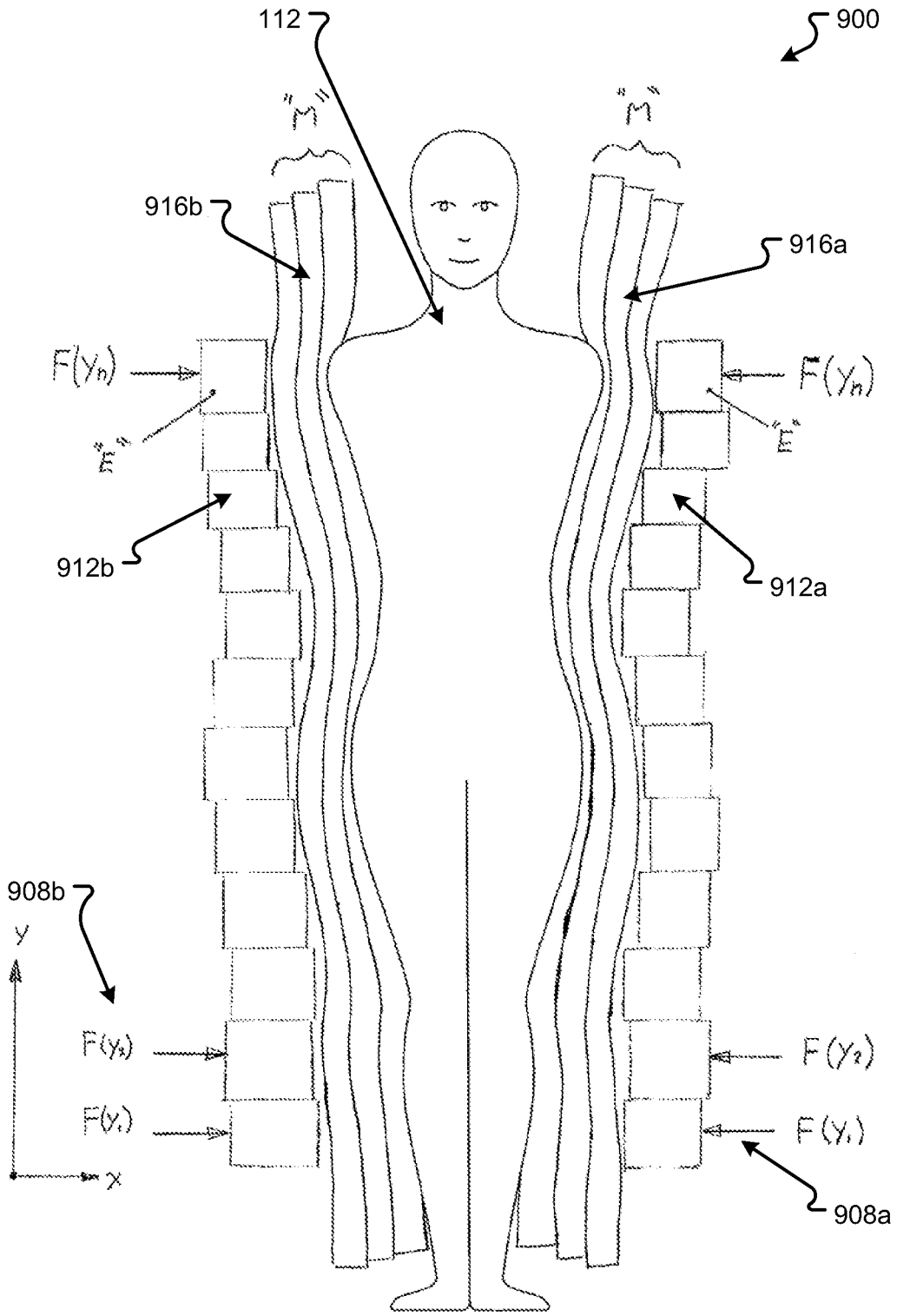
FIG. 12 is another diagram showing how a measurement of the user to determine the support surface profile is accomplished.
Figure 13:
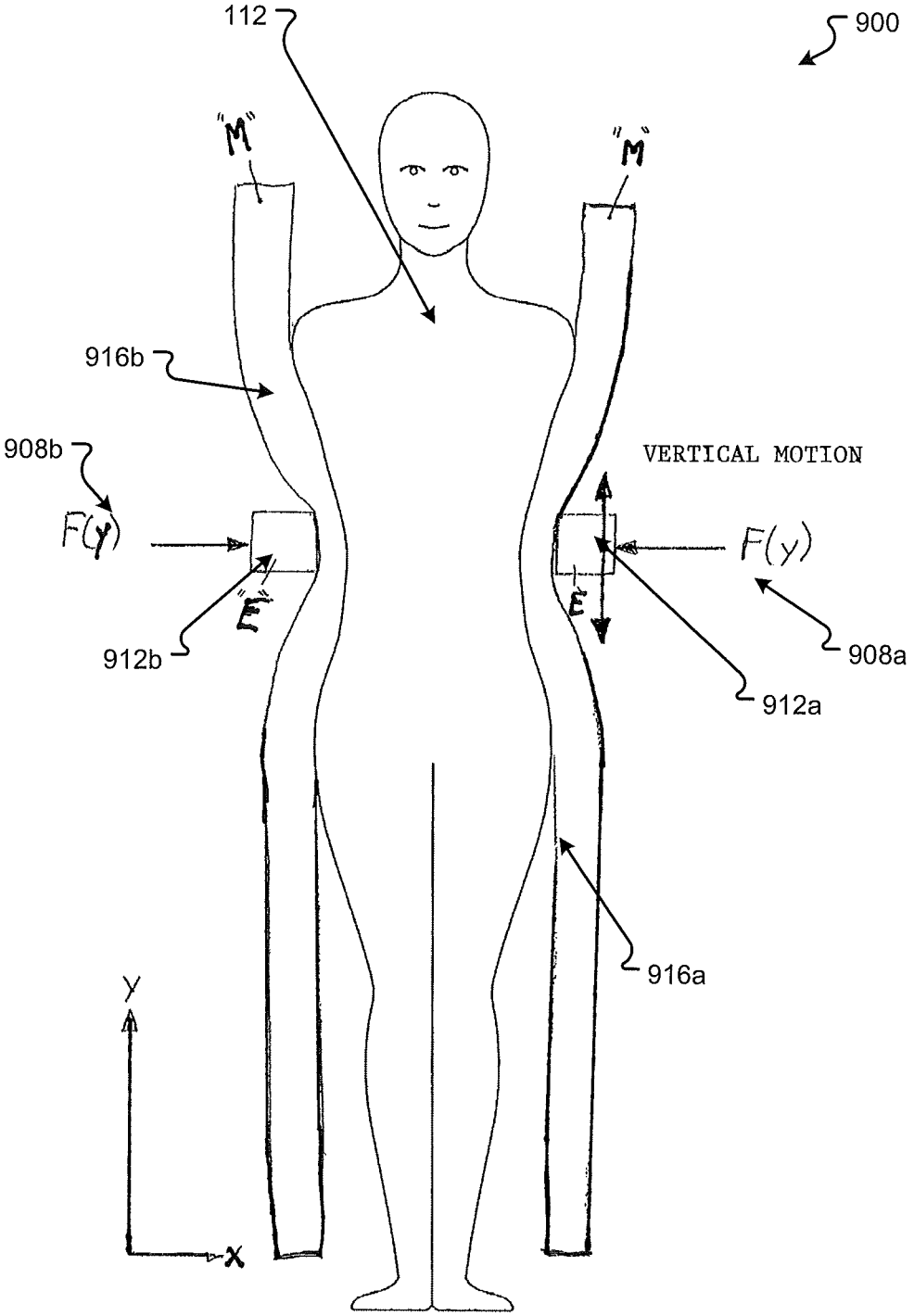
FIG. 13 is another diagram showing how a measurement of the user to determine the support surface profile is accomplished.

In some situations, beyond making several discreet measurements either individually or en masse, as shown in FIG. 12, the element E 912 may be moved up and down along the person's profile 106, as shown in FIG. 13. Here, the profile 106 measurements may be made periodically or constantly as element E 912 rolls in a vertical direction from the head to the feet (or vice versa) of the person 112. The force used with the rolling element may also be adjusted at different portions 108 to match the force needed or associated with the body segment.

The measurements made above may then be used to create or approximate the profile 106 of a support surface 104, in step 833. From the information garnered from determining the portion angle 320 and/or distance 316 at each portion position of the person 112, which is associated with the portions 108, the profile 106 for the entire support surface 104 is determined. The profile 106 of the person maintains the spine position of the sleeper 112 in the LSNSS position and/or neutral position while the user 112 is prone similar as to when the user 112 was standing to be measured. Optionally, a profile 106 may be approximated by fitting a curvilinear shape to a series of points that correspond only to the distances 316 measured at one or more portion positions associated with the portions 108.

Optionally, a correction factor may be applied, in step 834. A user 112 may test the profile 106 configuration on a test apparatus (a device, simulating a bed 100 upon which a user 112 can lay, which has movable slats that can approximate the measured profile). If one or more portions 108 of the profile 106 seem uncomfortable, a correction factor that adjusts the applied force 908 may be applied, as explained above in conjunction with step 826. The correction factor can change how the support is given to a user 112 at different locations on their body. Once the correction factor is applied, the user 112 may be re-measured. It should be noted that the user can be measured again with their body re-positioned. For example, a first profile may be determined for the user, when the user sleeps on their side. A second profile may then be generated for the user, when the user sleeps on their back. These two profiles may then be used to determine how to adjust the adjustable bed. The shape of these two profiles may be used to determine the location of pivot points and the degree of rotation.

Optionally, if the bed 100 is adjustable similar to the beds 100 shown in FIGS. 4A through 6C, the sections 612, pivot points 616, and degrees of rotation for the sections 612 may be determined, in step 835. As explained in conjunction with FIG. 8, if the bed 100 is to approximate a second profile 108, the locations of the sections 612 and pivot points 616 are determined. Further, the amount of rotation for each section 612 is determined, such that the amount of rotation ensures substantially the closest approximation of the second profile. The amount of rotation may be used by an automated or manual system to aid the user 112 in reconfiguring the bed 100 correctly.

The bed 100 may then be constructed having a support surface 104 with distance 312 and, possibly, angle 320 characteristics, for each portion 108, similar or the same as those measured above, in step 836. Additionally or alternatively, the bed 100 can also have sections, pivot points, and/or degrees of rotation as those measured above.

Support Curve Measurement Device (SCMD):

An embodiment of a SCMD 1500 for making the measurements of a user 112, as is described in conjunction with FIG. 8 through 14C, is shown in FIGS. 15-23. The SCMD 1500 can include one or more support structures 1516*a* and/or 1516*b*. The support structures 1516*a* and/or 1516*b* can be made of any rigid material, for example, metal, aluminum, etc. The support structures 1516*a* and/or 1516*b* may have a first end 1520*a* and a second end 1520*b*. Further, the support structures 1516*a* and/or 1516*b* may have a first side 1524*a* and a second side 1524*b*. Between the first end 1520*a* and the second end 1520*b*, one or more rods 1528*a-c*, which move or slide on linear bearings and which are attached to the support structure 1516. The rods may be made from a rigid material, for example, steel. The rods 1528 can from a first side 1524*a* to the second side 1524*b* and may move or be affixed substantially parallel to the ground. The rods 1528 can slide with minimal friction to prevent influence on the measurement of the profile 106.

An extension slide 1512 may be placed in or attached to the low-friction rods 1528 of two of the support structures 1516. The extension slide 1512 may be formed from a rigid material, e.g., wood, metal, plastic, etc. The extension slide 1512 may be a square or rectangle component having a width substantially the same as the rods 1528 width. To extend the extension slide 1512, the extension slide 1512 can slide in the rods 1528 from a first side 1524*a* of the support structure 1516 to a second side 1524*a* of the support structure 1516. As such, the extension slide 1512 may have a width that is less than the length of the rods 1528.

An armature 1508 may be further connected or affixed to the extension slide 1512. In some configurations, an armature 1508 is affixed to each side of the of the extension slide 1512. The armatures 1508 can be made from any rigid material, for example, metal, plastic, etc. Each armature 1508 may extend past the end of the extension slide 1512 and hold an element 1544. Thus, the armature 1508 is connected to the element 1544 at the armature's end. The element 1544 can be slide into the user's side, back, or front, with a predetermined amount of force as described in conjunction with FIG. 8 through FIG. 14C.

There may be one or more elements 1544A, 1544B, etc, that may be affixed or connected to one or more armatures 1508. The elements 1544 can also be made from a rigid material, e.g., wood, metal, plastic, etc. The elements 1544 may have a shape and configuration as described in conjunction with FIG. 14A-14C and/or FIG. 20. The elements 1544A, 1544B, once positioned on the mattress 120 or the user 112, may then measure or approximate the angle 320 and/or a distance 316 from a set point. These measurements can provide the information for the profile 106 described hereinbefore.

Figure 15:
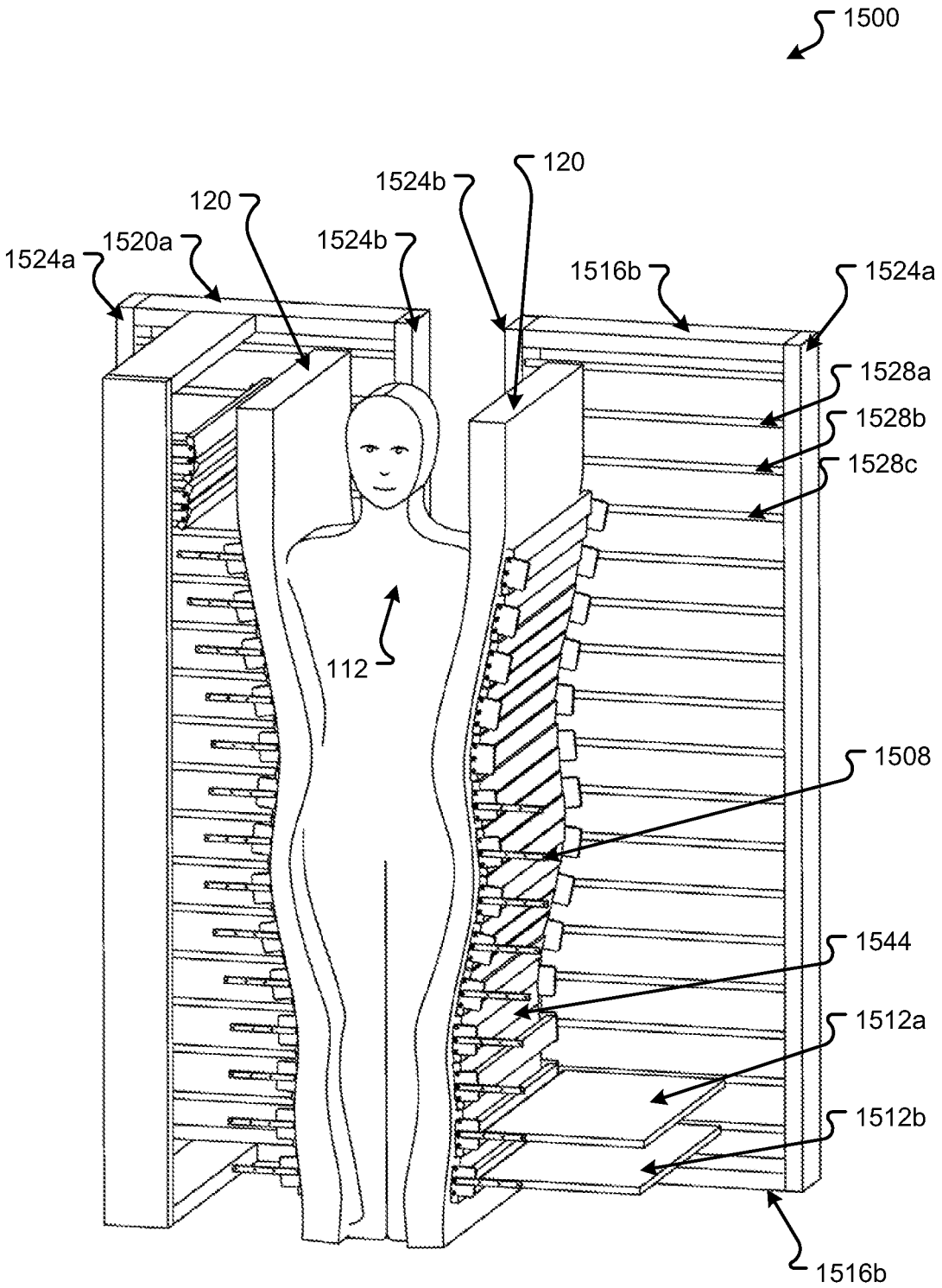
FIG. 15 is a representation of a measurement system used to measure the profile of the support surface that corresponds to the user.
Figure 16:
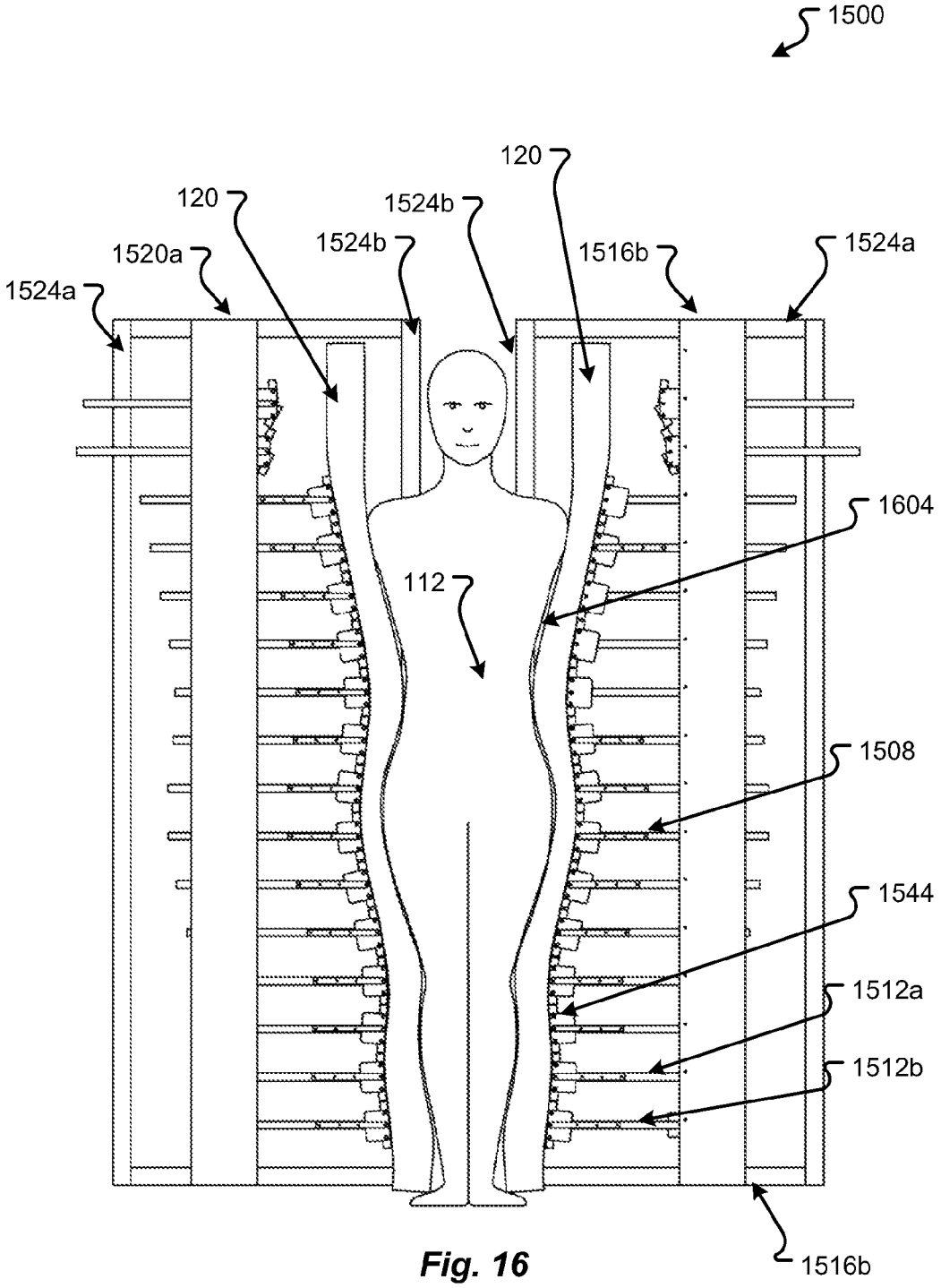
FIG. 16 is a representation of a measurement system used to measure the profile of the support surface that corresponds to the user.
Figures 17A, 17B, 17C:
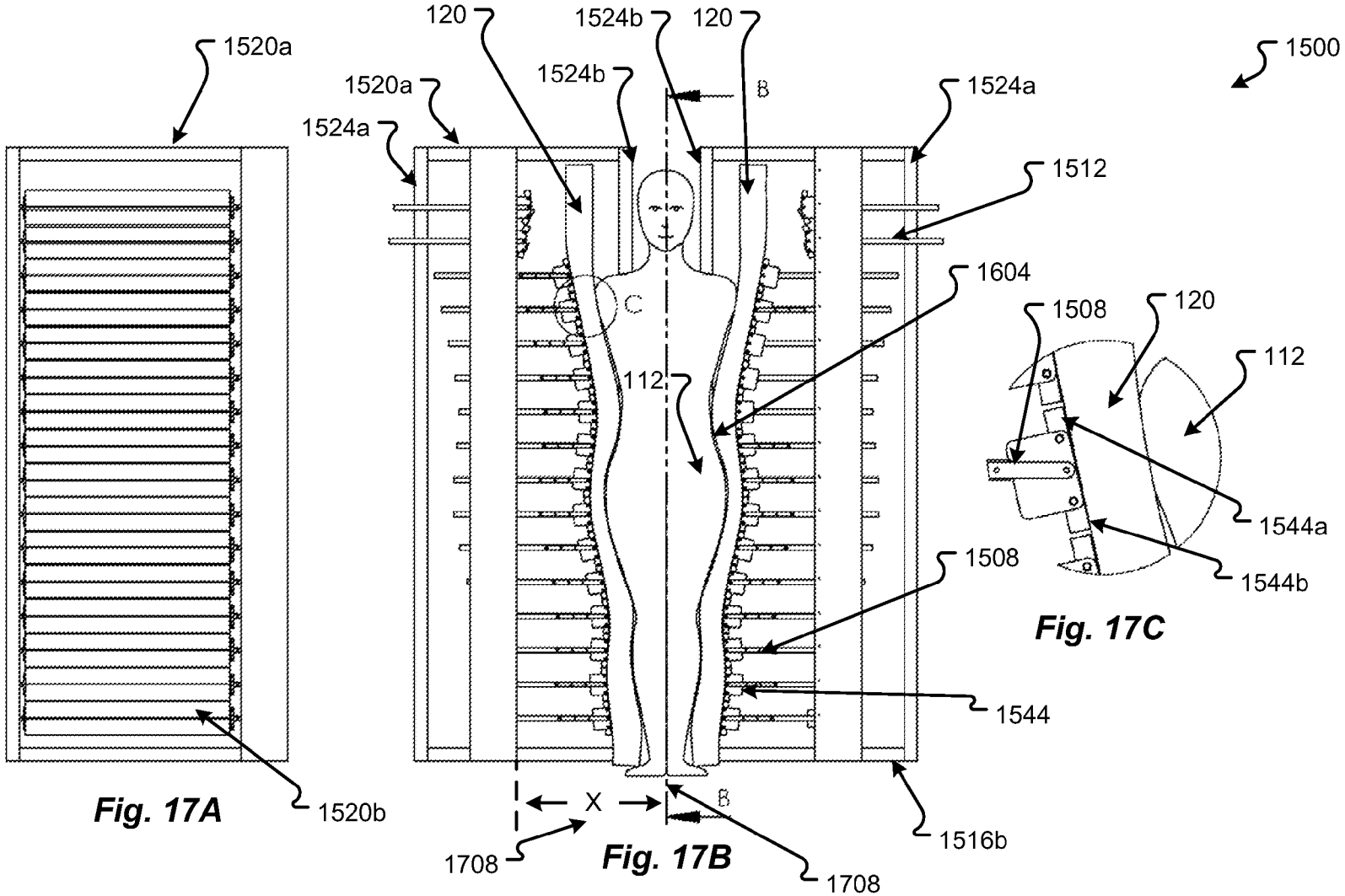
FIGS. 17A, 17B, and 17C are representations of a measurement system used to measure the profile of the support surface that corresponds to the user.

In other situations, the operator may obtain an image of the profile 106 associated with a user's needed support surface 104, while the elements 1544 are in connection with the mattress 120 or side of the person 112. For example, the profile 106 along each side 1604, as shown in FIG. 16, may be imaged. This image may then be used to construct the profile 106, which can be used to construct the support surface 104. In other situations, the angle of the connection or deflection of the element 1544, as shown in FIG. 17C, may be determined for each element. As shown in FIGS. 15, 19B, and 22, the armature 1508 is attached to two elements 1544A and 1544B. Each element 1544 may have an angle of deflection 1704, 2204 from a vertical position. The angle of deflection 2204 for each element 1544 may be determined by sensors or other types of electromechanical devices. The angle of deflection 2204 then becomes the portion angle 320 for the support surface 104. The amount of extension of an armature 1508, as shown in FIG. 17B as measurement 1708, may be used to determine the height 316 of the portion 108.

Figures 18A, 18B, 18C, 18D:
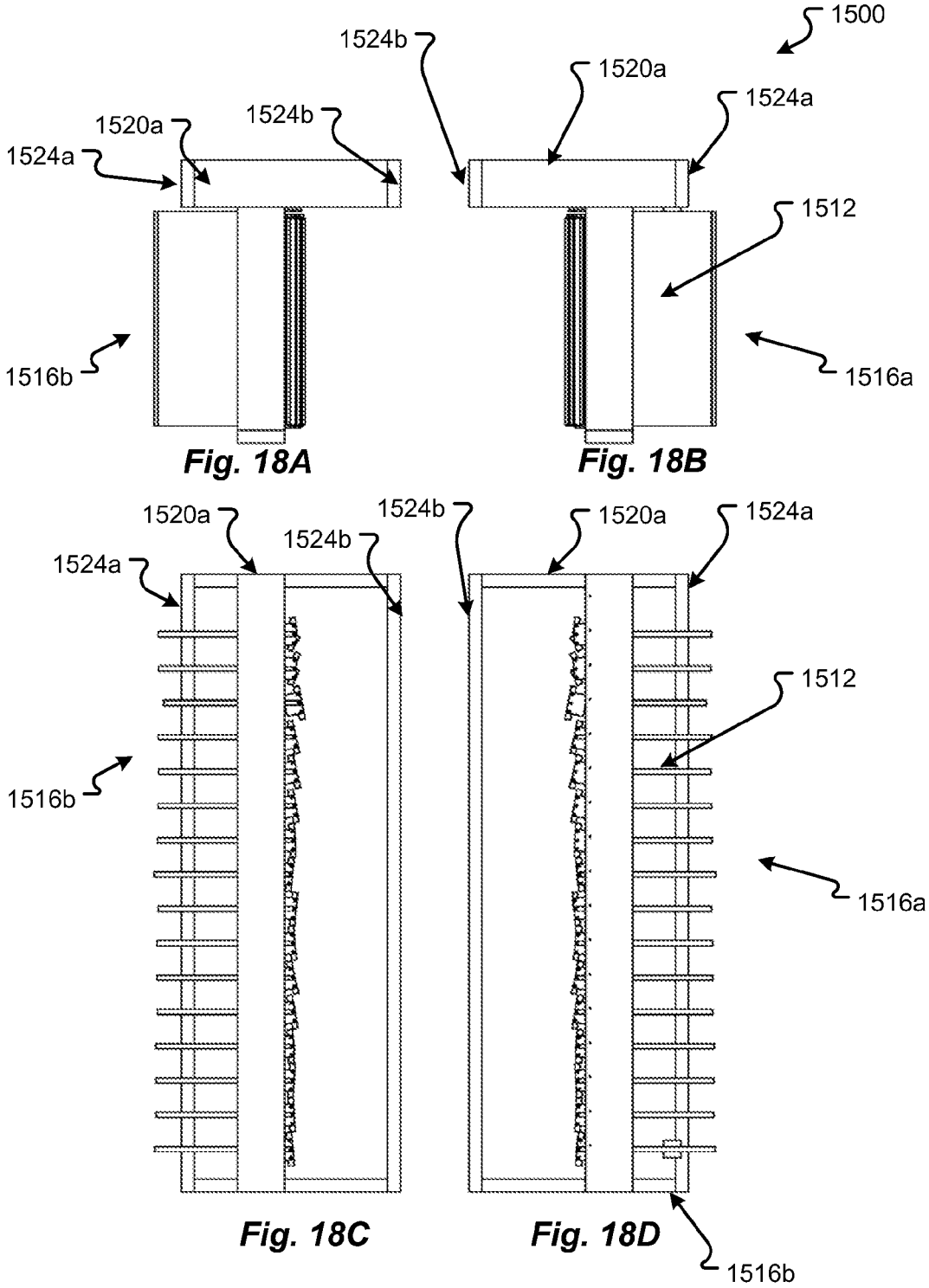
FIGS. 18A, 18B, 18C, and 18D are representations of a measurement system used to measure the profile of the support surface that corresponds to the user.

Armatures 1508 and elements 1544 may apply symmetrical forces on each side of the person, as shown in FIG. 17B, to maintain the person's spine position, as indicated by line B 1712. Optionally, the system 1500 may make measurements with both the support structures 1516*a* and 1516*b*, as shown in FIGS. 18B and 18A. Each of these different support structures 1516*a* and 1516*b* may have one or more armatures 1508 configured thereon with elements 1544, as shown in FIGS. 18C and 18D.

Figure 19A:
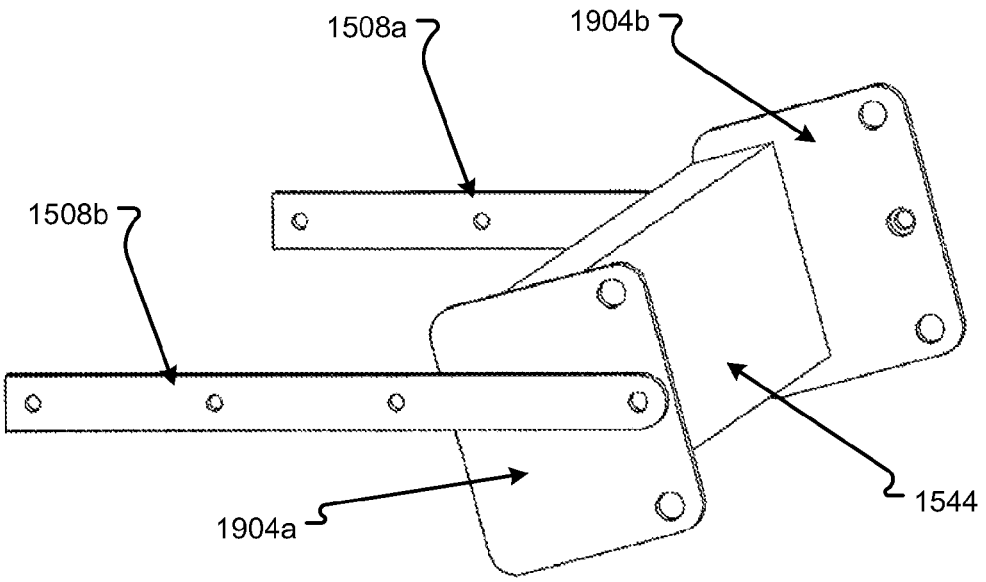
FIGS. 19A and 19B are representations of embodiments of elements in a measurement system used to measure the profile of the support surface that corresponds to the user.
Figure 19B:
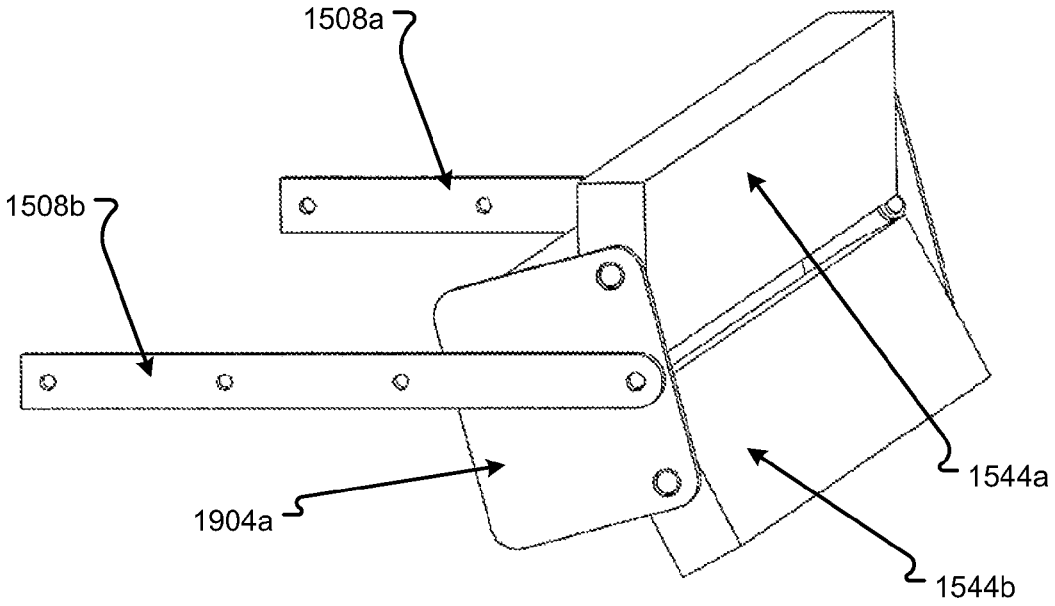

An example of an armature 1508 with a connector assembly 1904 providing an element 1544 between the connecting plates is shown in FIGS. 19A and 19B. Here, the element 1544 is connected between the two connecting plates 1904*a* and 1904*b*, and then the elements 1544 rotate or pivot to determine an angle for the body segment of the user 112. Another embodiment of an element 1544 configuration is shown in FIG. 19B, where two elements 1544*a* and 1544*b* are pivotally connected to the same connecting plate 1904*a* and *b*. The connecting plate 1904 may be made from a rigid material, for example, metal, plastic, etc.

Figure 20:
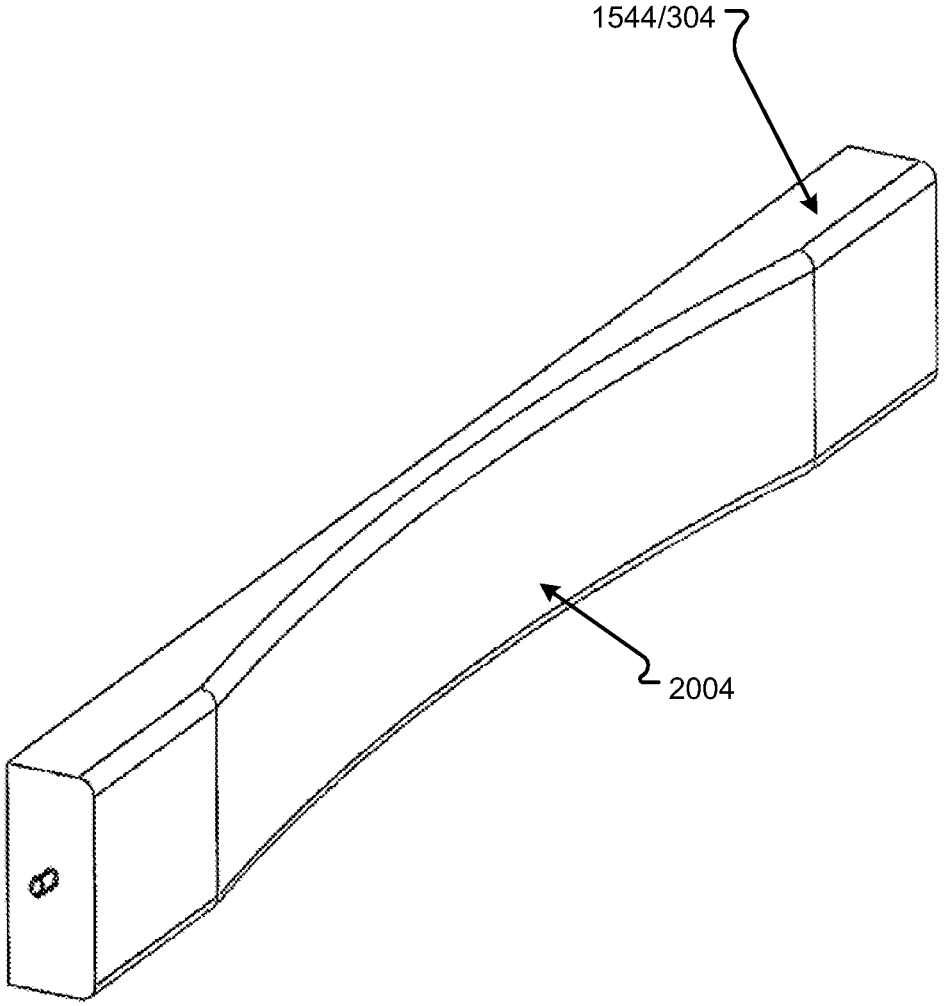
FIG. 20 is a representation of an embodiment of a slat that may form a support surface of a sleep system or of an embodiment of an element that may form a part of the measurement system.

An embodiment of an element 1544 or a slat 304 may be shown in FIG. 20. The element 1544 or the slat 304 can include a chamfered or relieved area 2004. The relieved area may provide some further beneficial comfort for the user 112.

Figure 21:
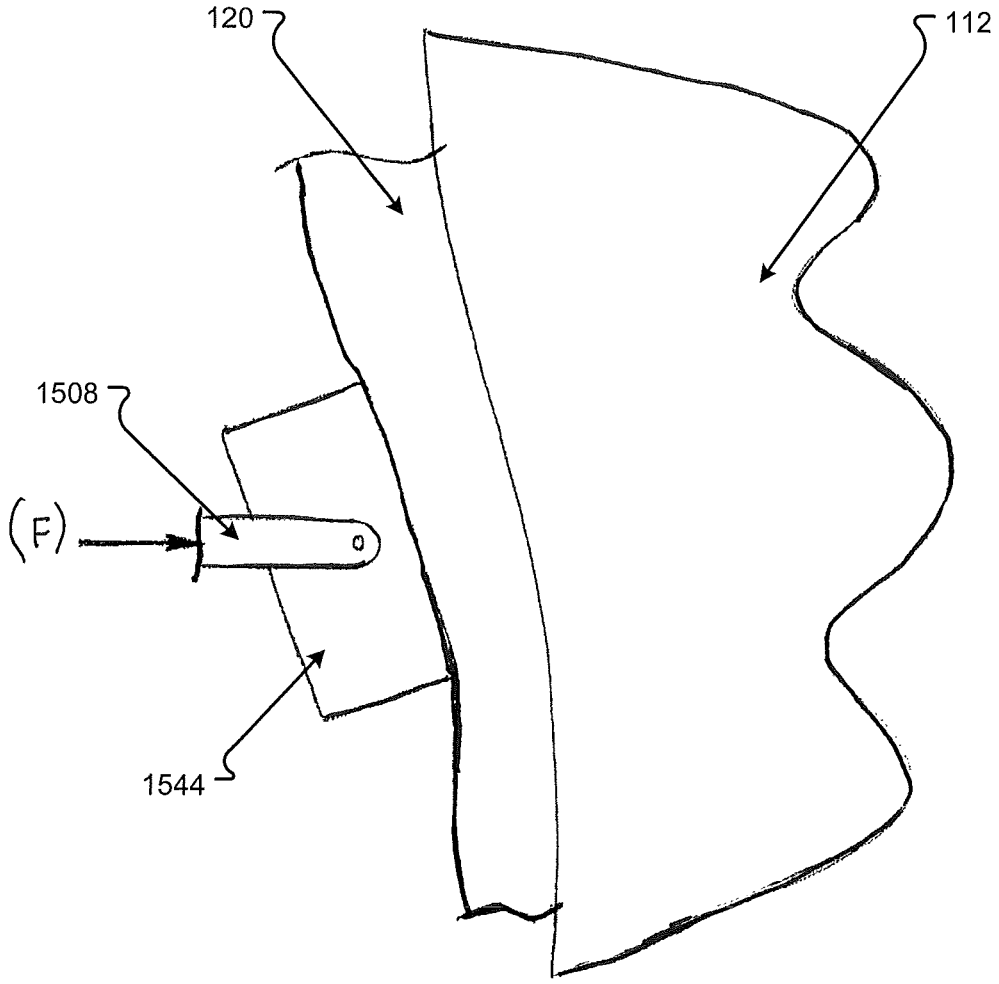
FIG. 21 is a representation of an embodiment of an element in a measurement system used to measure the profile of the support surface that corresponds to the user.

An embodiment of the element 1544 coming in contact with the body is shown in FIG. 21. Here, the element 1544 configuration, from FIG. 19A, is shown being pressed against the side of a person 112. The element 1544 configuration, shown in FIG. 19B, is shown as contacting the user 112 in FIG. 22.

Figure 23:
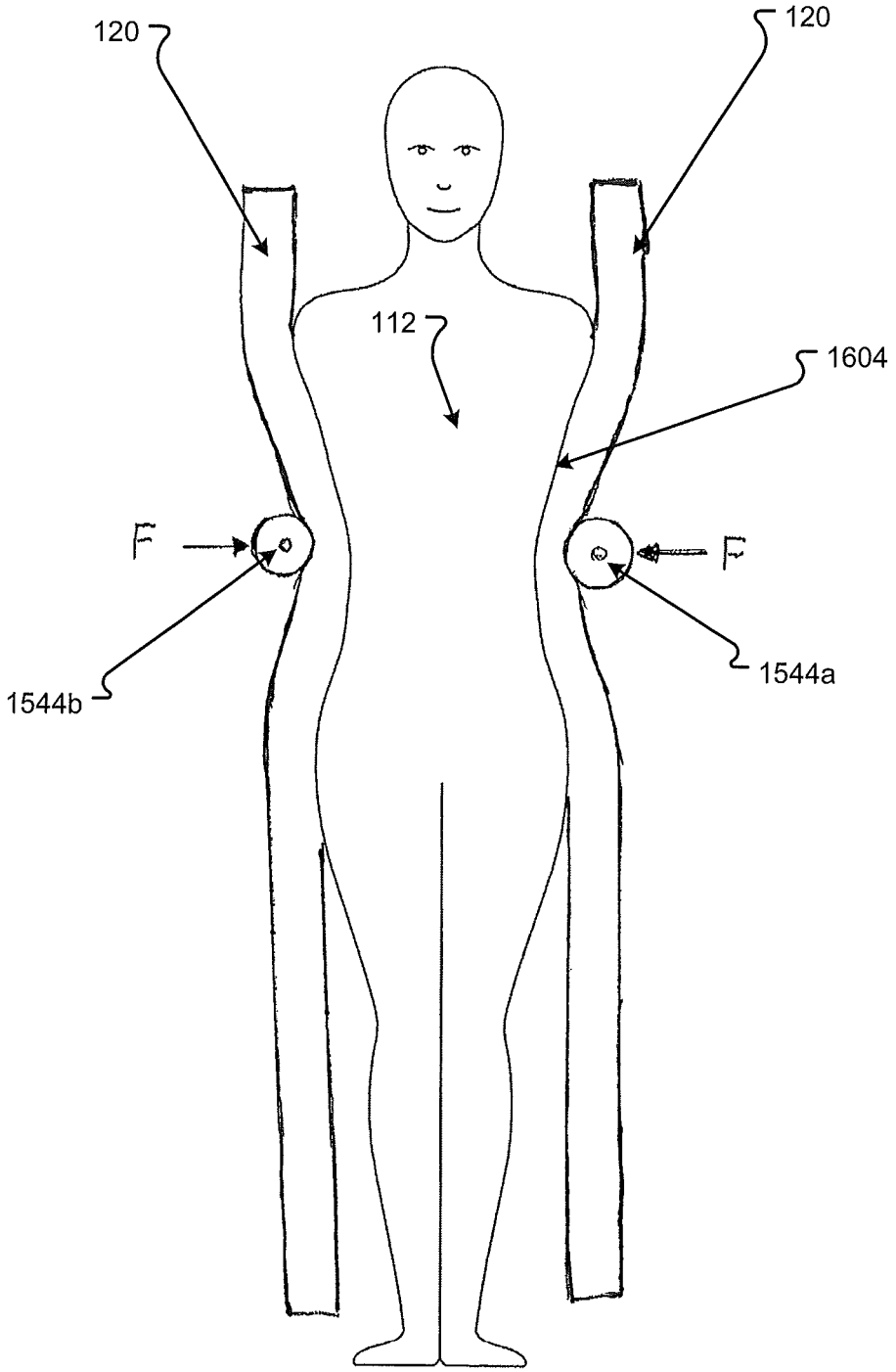
FIG. 23 is a representation of an embodiment of an element in a measurement system used to measure the profile of the support surface that corresponds to the user.

A further embodiment of a measurement system may include one or more roller elements that move vertically and apply a force as is shown in FIG. 23. Here, rather than having the element 1544 configurations shown in FIG. 19A or 19B, a single element may be connected to the connecting plates 1904 and connected between armatures 1508*a* and 1508*b*. The roller element 1544 may be circular and be able to roll along the side of the user as force is applied into the person's body. The profile 106 of the support curve may be determined as the element 1544 rolls along the profile 106 of the user 112.

Figures 14A, 14B, 14C:
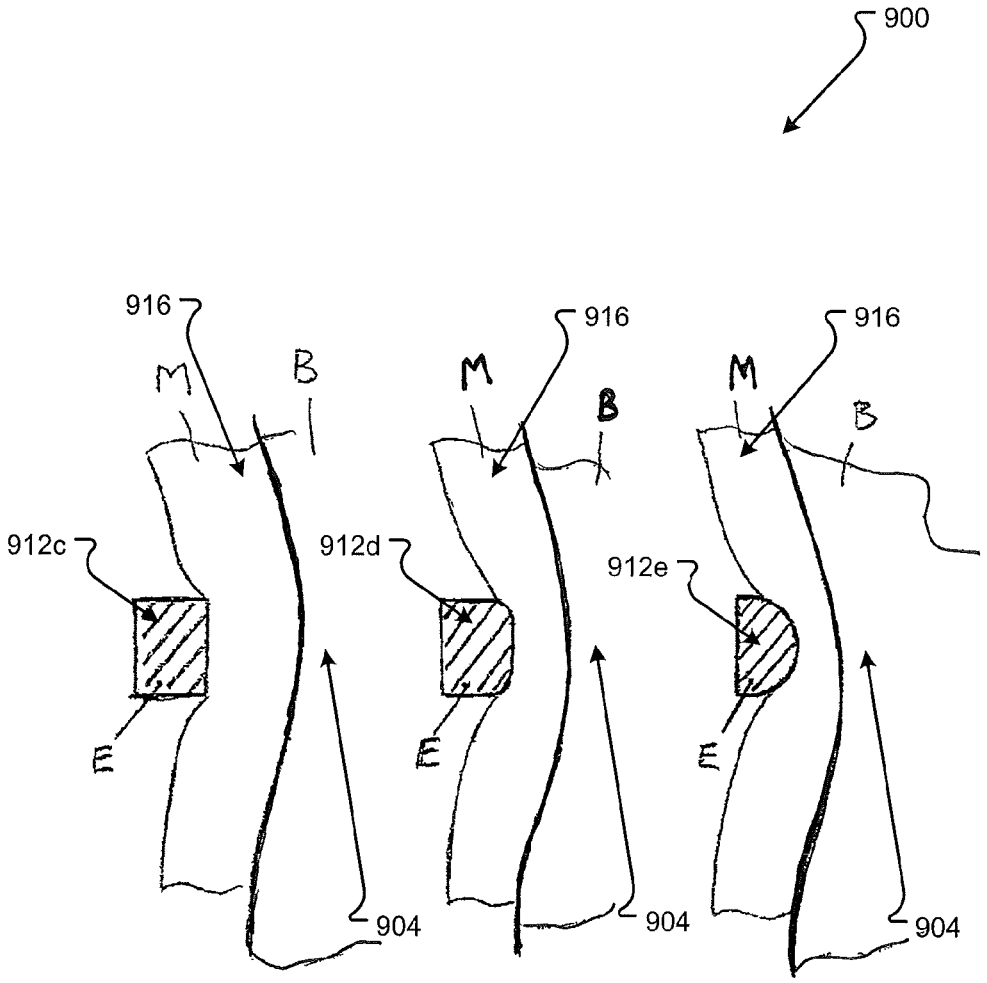
FIGS. 14A, 14B, and 14C are representations of a cross section of an embodiment of a element used to measure the profile of a support surface.

The elements 912 may have one or more different configurations as shown in FIGS. 14A through 14C. An element may have a square or sharp angle profile 106 as shown in FIG. 14A. In other situations, the corners of the element 912 may be rounded as shown in FIG. 14B. In still other situations or examples, the element 912 may have a semicircular profile 106, as shown in FIG. 14C. Still further, the elements 912 may also be a set of rollers, as shown in FIG. 13, for moving or rolling along the profile 106 of a user 112. Depending on how the measurements are taken, or how element E 912 moves in a vertical direction, as described in conjunction with FIG. 13, the element 912 may have different profile 106*s* as shown in FIGS. 14A through 14C.

The exemplary systems and methods of this disclosure have been described in relation to configurable beds. However, to avoid unnecessarily obscuring the present disclosure, the preceding description omits a number of known structures and devices. This omission is not to be construed as a limitation of the scopes of the claims. Specific details are set forth to provide an understanding of the present disclosure. It should however be appreciated that the present disclosure may be practiced in a variety of ways beyond the specific detail set forth herein.

Furthermore, while the exemplary aspects, embodiments, and/or configurations illustrated herein show the various components of the system, other configurations are possible. Thus, it should be appreciated, that the components of the system can be combined into one or more constructs. It will be appreciated from the preceding description, and for reasons of efficiency, that the components of the system can be arranged at any location without affecting the operation of the system. Similarly, one or more functional portions of the system could be arranged differently.

Furthermore, it should be appreciated that some of the various connections of the elements can be adhered with glue, epoxy, etc., may be mechanically attached with screws, nails, bolts, may be bonded by welding or other process, or may be affixed in other methods or by other means.

Also, while the flowcharts have been discussed and illustrated in relation to a particular sequence of events, it should be appreciated that changes, additions, and omissions to this sequence can occur without materially affecting the operation of the disclosed embodiments, configuration, and aspects.

A number of variations and modifications of the disclosure can be used. It would be possible to provide for some features of the disclosure without providing others.

The portions of systems and methods of this disclosure can be implemented in conjunction with a special purpose computer, a programmed microprocessor or microcontroller and peripheral integrated circuit element(s), an ASIC or other integrated circuit, a digital signal processor, a hardwired electronic or logic circuit such as discrete element circuit, a programmable logic device or gate array such as PLD, PLA, FPGA, PAL, special purpose computer, any comparable means, or the like. In general, any device(s) or means capable of implementing the methodology illustrated herein can be used to implement the various aspects of this disclosure. Exemplary hardware that can be used for the disclosed configurations and aspects includes computers, handheld devices, telephones (e.g., cellular, Internet enabled, digital, analog, hybrids, and others), and other hardware known in the art. Some of these devices include processors (e.g., a single or multiple microprocessors), memory, nonvolatile storage, input devices, and output devices. Furthermore, alternative software implementations including, but not limited to, distributed processing or component/object distributed processing, parallel processing, or virtual machine processing can also be constructed to implement the methods described herein.

Further, the disclosed methods may be readily implemented in conjunction with software using object or object-oriented software development environments that provide portable source code that can be used on a variety of computer or workstation platforms. Alternatively, the disclosed system may be implemented partially or fully in hardware using standard logic circuits or VLSI design. Whether software or hardware is used to implement the systems in accordance with this disclosure is dependent on the speed and/or efficiency requirements of the system, the particular function, and the particular software or hardware systems or microprocessor or microcomputer systems being utilized.

The disclosed methods may be partially implemented in software that can be stored on a storage medium, executed on programmed general-purpose computer with the cooperation of a controller and memory, a special purpose computer, a microprocessor, or the like. In these instances, the systems and methods of this disclosure can be implemented as program embedded on personal computer such as an applet, JAVA® or CGI script, as a resource residing on a server or computer workstation, as a routine embedded in a dedicated measurement system, system component, or the like. The system can also be implemented by physically incorporating the system and/or method into a software and/or hardware system.

The present disclosure, in various aspects and/or configurations, includes components, methods, processes, systems and/or apparatus substantially as depicted and described herein, including various aspects, embodiments, configurations embodiments, subcombinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and\or reducing cost of implementation.

The foregoing discussion has been presented for purposes of illustration and description. The foregoing is not intended to limit the disclosure to the form or forms disclosed herein. In the foregoing Detailed Description, for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A sleep system, comprising:

one or more members, each member comprising:

a first end;

a second end;

a second side resting on a bearing surface; and a first side, wherein a profile is formed in the first side, the profile forming a support surface for the sleep system, wherein the sleep system is configured to support a user on the support surface with a head of the user at the first end and a foot of the user at the second end, wherein the profile of the first side maintains a spine of the user in a low-stress neutral spinal shape position as measured when the user is standing, wherein the low-stress neutral spinal shape position is similar to a spinal shape of the user when the user is standing, wherein the profile is specific to the user, and wherein the profile is generated by a method comprising:

placing a mattress between a body of a user and a measuring device, while the user is standing in a relaxed position, wherein the mattress comprises a compliant layer having a first density;

determining at least first and second body segments to obtain a measurement;

for each body segment, determining a body mass of a portion of the user associated with the body segment;

based on the determined body mass, determining a force to apply at each body segment;

applying the force to the mattress on each side of the user at each body segment with an element connected to an armature of a support curve measurement device;

while applying the force, measuring one or more of an angle of the element when applying the force to the mattress, and an amount of distance moved for the element when applying the force to the mattress, wherein the amount of distance moved for the element when applying the force to the mattress depends on the first density of the mattress and the movement of the body segment; and based on the measurements of one or more of the angle and the amount of distance at each body segment, approximating the profile.

2. The sleep system of claim 1, wherein the one or more members are made from a rigid material.

3. The sleep system of claim 2, wherein the rigid material is a plastic, a metal, or a wood.

4. The sleep system of claim 2, wherein the first profile is one of formed or carved into the first side.

5. The sleep system of claim 4, wherein the one or more members include two or more portions, and wherein the two or more portions form the profile, wherein each portion of the profile is based on measurements of one of the measured body segments.

6. The sleep system of claim 5, wherein each portion includes the angle of the profile.

7. The sleep system of claim 6, wherein each portion includes the height from the bearing surface to the first side.

8. The sleep system of claim 7, wherein the force is based on a required support for the body segment of the user that is positioned over the portion, wherein the required support is determined by the height of the portion needed to maintain the spine position at a position of the portion in the profile to counteract a force of gravity on a mass of the user at that body segment.

9. The sleep system of claim 8, further comprising two or more slats, each slat affixed to the first side of two or more members, wherein the slat spans between two or more members, wherein a top of the slat forms a first sleep surface.

10. The sleep system of claim 9, wherein each slat is formed from a second rigid material.

11. The sleep system of claim 10, wherein the second rigid material is one of a plastic, a wood, or a metal.

12. The sleep system of claim 11, wherein each slat has dimensions defined by dimensions of the portion.

13. The sleep system of claim 12, further comprising the mattress placed upon the two or more slats.

14. The sleep system of claim 13, wherein a top of the mattress forms a second sleep surface.

15. The sleep system of claim 1, wherein the mattress comprises a second compliant layer.

16. The sleep system of claim 15, wherein the second compliant layer has a second density.

17. The sleep system of claim 16, wherein the two or more members include a raised section formed to support the head of the user.

18. The sleep system of claim 17, wherein the first layer extends over the raised section and the second layer ends before the raised section.

19. A sleep system, comprising:

two or more members separated by a distance, each member comprising:

a second side resting on a bearing surface;

a first side, wherein a profile is formed in the first side, wherein the sleep system is configured to support a user sleeps on the support surface with a head of the user at the first end and a foot of the user at the second end, wherein the profile of the first side maintains a spine of the user in a low-stress neutral spinal shape position as measured when the user is standing, wherein the low-stress neutral spinal shape position is similar to a spinal shape of the user when the user is standing, wherein the profile is specific to the user, and, wherein the profile is generated by a method comprising:

placing a mattress between a body of a user and a measuring device, while the user is standing in a relaxed position;

determining at least first and second body segments to obtain a measurement;

for each body segment, determining a body mass of a portion of the user associated with the body segment;

based on the determined body mass of the portion of the user associated with the body segment and a force of gravity, determining a force to apply at each body segment;

applying the force to the mattress on each side of the user at each body segment with an element connected to an armature of a support curve measurement device;

while applying the force, measuring one or more of an angle of the element when applying the force to the mattress, and an amount of distance moved for the element when applying the force to the mattress; and while applying the force, determining the profile forming the support surface for the sleep system based on the measurements of one or more of the angle and the amount of distance at each body segment;

a first end; and a second end separate, wherein a length of the two or more members is between the first end and the second end;

wherein the two or more members comprise two or more portions, and wherein each portion includes the measured angle and the measured distance from the bearing surface, wherein the angle and height of each of the portions forms the profile;

two or more slats, wherein each slat is affixed to the first side of two or more members, wherein each of the slats spans the distance between the two or more members, wherein a top of the slat forms a first sleep surface, and wherein each slat has dimensions defined by the portion;

the mattress placed upon the two or more slats, wherein a top of the mattress forms a second sleep surface;

wherein the user sleeps on one of the first or second sleep surface with a head of the user at the first end and a foot of the user at the second end; and wherein the first or second sleep surfaces maintains a spine of the user in the low-stress neutral spinal shape position.

20. A sleep system, comprising:

a first section;

a second section attached to the first second at a pivot, wherein the second section rotates at the pivot with respect to the first section;

wherein each of the first section and the second section comprises:

two or more members separated by a distance, each member comprising:

a second side, wherein at least a portion of the second side rests on a bearing surface;

a first side, wherein a profile is formed in the first side, wherein the profile forms a support surface for the sleep system, wherein the profile of the first side maintains a spine of the user in a low-stress neutral spinal shape position, as measured when the user is standing, while a user lies on a side, wherein the profile is generated by a method comprising:

placing a mattress between a body of a user and a measuring device, while the user is standing in a relaxed position, wherein the mattress comprises a compliant layer having a first density;

determining at least first and second body segments to obtain a measurement;

for each body segment, determining a body mass of a portion of the user associated with the body segment;

based on the determined body mass of the portion of the user associated with the body segment and a force of gravity, determining a force to apply at each body segment;

applying the force to the mattress on each side of the user at each body segment with an element connected to an armature of a support curve measurement device;

while applying the force, measuring an angle of the element when applying the force to the mattress and an amount of distance moved for the element when applying the force to the mattress, wherein the amount of distance moved for the element when applying the force to the mattress depends on the first density of the mattress and the movement of the body segment; and while applying the force, determining the profile forming the support surface for the sleep system based on the measurements of one or more of the angle and the amount of distance;

a first end; and a second end separate, wherein a length of the two or more members is between the first end and the second end, and wherein the length of the two or more members is less than a total height of the user;

wherein the two or more members comprise two or more portions, and wherein each portion includes the measured angle and the measure amount of distance from the second side, wherein the angle and amount of distance of each of the portions forms the profile;

the mattress placed upon the two or more slats of each section, wherein a top of the mattress forms a second sleep surface;

wherein the user sleeps on one of a first or a second sleep surface with a head of the user at the first end and a foot of the user at the second end;

wherein by rotating the second section with respect to the first section, the sleep system adjusts the second sleep surface between a first profile and a second profile;

wherein the first profile maintains a spine of the user in a first low-stress neutral spinal shape position when the user sleeps on a side; and wherein the second profile maintains a spine of the user in a second low-stress neutral spinal shape position when the user sleeps on a back, wherein the low-stress neutral spinal shape position is similar to a spinal shape of the user when the user is standing.

21. The sleep system of claim 1, wherein the mattress comprises more than two compliant layers.

* * * * *